US007484537B2

(12) United States Patent
Ueda

(10) Patent No.: US 7,484,537 B2
(45) Date of Patent: Feb. 3, 2009

(54) INDUSTRIAL TWO-LAYER FABRIC

(75) Inventor: Ikuo Ueda, Shizuoka (JP)

(73) Assignee: Nippon Filcon Co., Ltd., Tokyo (JP)

( * ) Notice: Subject to any disclaimer, the term of this patent is extended or adjusted under 35 U.S.C. 154(b) by 183 days.

(21) Appl. No.: 11/500,924

(22) Filed: Aug. 9, 2006

(65) Prior Publication Data

US 2007/0095416 A1 May 3, 2007

(30) Foreign Application Priority Data

Oct. 17, 2005 (JP) ..... 2005-301561

(51) Int. Cl.
*D21F 7/08* (2006.01)
*D03D 25/00* (2006.01)

(52) U.S. Cl. ..... 139/383 A; 162/358.2

(58) Field of Classification Search ..... None
See application file for complete search history.

(56) References Cited

U.S. PATENT DOCUMENTS 4,438,788 A * 3/1984 Harwood ..... 139/383 AA
4,453,573 A * 6/1984 Thompson ..... 139/383 A
4,564,052 A * 1/1986 Borel ..... 139/425 A
4,592,395 A * 6/1986 Borel ..... 139/383 A
4,611,639 A * 9/1986 Bugge ..... 139/383 A
4,640,741 A * 2/1987 Tsuneo ..... 162/202
4,709,732 A * 12/1987 Kinnunen ..... 139/383 A
4,729,412 A * 3/1988 Bugge ..... 139/383 A
4,815,503 A * 3/1989 Borel ..... 139/383 A
4,821,780 A * 4/1989 Tate ..... 139/383 A
5,343,896 A * 9/1994 Schroder et al. ..... 139/383 A
5,454,405 A 10/1995 Hawes
5,645,112 A * 7/1997 Lee ..... 139/383 A
5,975,148 A * 11/1999 Lee ..... 139/383 A
6,155,308 A * 12/2000 Kuji ..... 139/410
6,189,577 B1 * 2/2001 Lee ..... 139/383 A
6,354,335 B1 3/2002 Taipale et al.
6,926,043 B2 * 8/2005 Quigley et al. ..... 139/383 A
7,270,152 B2 * 9/2007 Ueda et al. ..... 139/383 A
2003/0010393 A1 1/2003 Kuji
2003/0178087 A1 * 9/2003 Odenthal ..... 139/383 A
2004/0104005 A1 * 6/2004 Brewster et al. ..... 162/358.2
2004/0182465 A1 * 9/2004 Ward ..... 139/383 A
2004/0206414 A1 * 10/2004 Festor ..... 139/383 A (Continued)

FOREIGN PATENT DOCUMENTS

EP 1-734-177 A 12/2006

OTHER PUBLICATIONS

Office Communication dated May 20, 2008 (EPO).

*Primary Examiner*—Bobby H Muromoto, Jr.
(74) *Attorney, Agent, or Firm*—Rader, Fishman & Grauer, PLLC

(57) ABSTRACT

In an industrial two-layer fabric, one upper surface side warp and three warp binding yarns are disposed adjacent to each other. Each of the three warp binding yarns appears on the upper side surface in turn and passes over different one or two successive upper surface side wefts. At least one upper surface side weft exists between knuckles formed on the upper side surface by the three warp binding yarns. Adjacent to the upper surface side warp, these three warp binding yarns get together to form on the upper side surface a design which is the same design formed by an upper surface side warp.

9 Claims, 12 Drawing Sheets

U.S. PATENT DOCUMENTS

2004/0238063 A1* 12/2004 Stone ..... 139/383 A
2005/0268981 A1* 12/2005 Barratte ..... 139/383 A
2006/0102244 A1* 5/2006 Ueda et al. ..... 139/383 A
2006/0116042 A1* 6/2006 Nagura et al. ..... 442/205
2006/0162804 A1* 7/2006 Heger et al. ..... 139/383 A
2006/0278297 A1* 12/2006 Ueda ..... 139/383 A

* cited by examiner

FIG. 19A
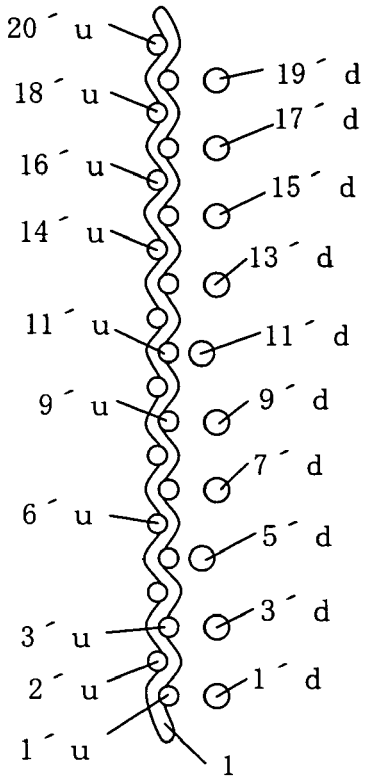
FIG. 19B
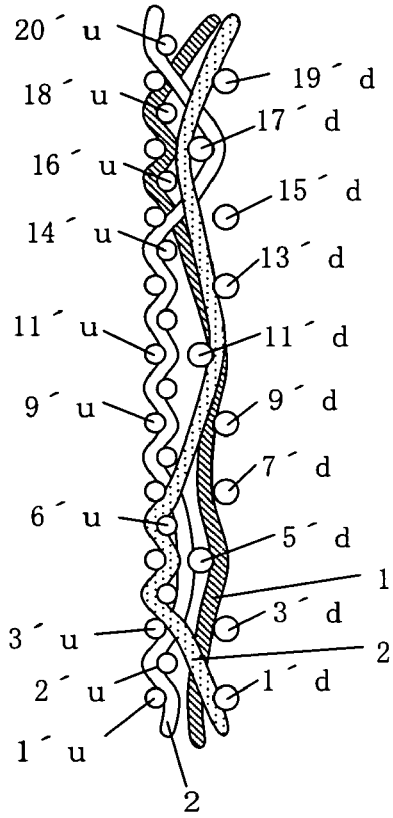
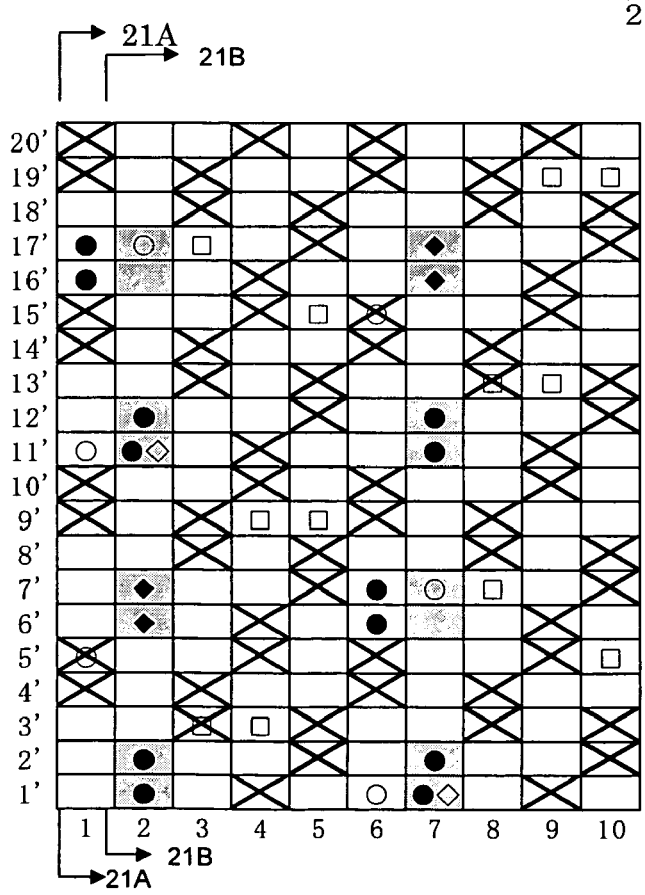
FIG. 20

FIG. 21A
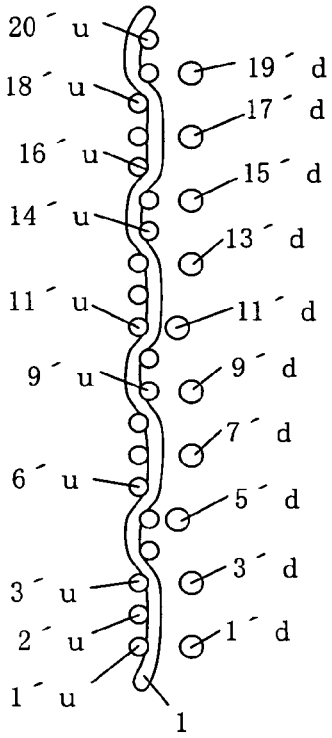
FIG. 21B
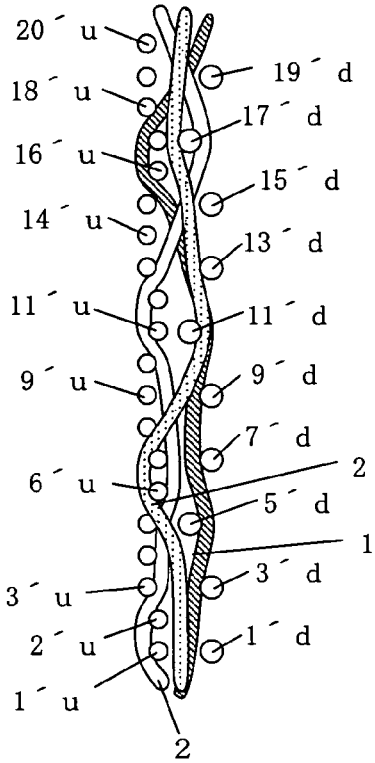
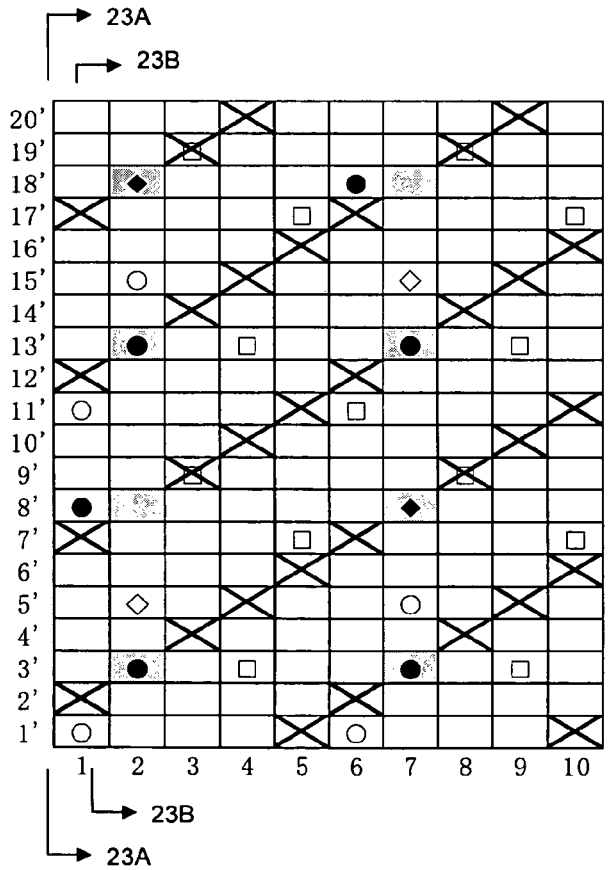
FIG. 22

INDUSTRIAL TWO-LAYER FABRIC

TECHNICAL FIELD

The present invention relates to an industrial two-layer fabric having especially excellent breathability, surface property and fabric rigidity.

BACKGROUND ART

Fabrics woven with warps and wefts have conventionally been used widely as an industrial fabric. They are used in various fields including papermaking wires, conveyor belts and filter cloths and required to have fabric properties suited for the intended use or using environment. Of such fabrics, a papermaking wire used in a papermaking step for removing water from raw materials by making use of the meshes of a fabric must satisfy severe requirements. There is therefore a demand for the development of fabrics which hardly transfer their wire marks to paper and therefore have an excellent surface property, have a dehydration property for sufficiently removing unnecessary water contained in the raw materials, have enough wear resistance and rigidity to permit desirable use even under severe environments, and are capable of maintaining conditions necessary for making good-quality paper for a long period of time. In addition, fiber supporting property, improvement in a papermaking yield, dimensional stability and running stability are required. In recent years, owing to the speed-up of a papermaking machine, requirements for papermaking wires become severe further.

Since most of the requirements for industrial fabrics and how to satisfy them can be understood by describing a papermaking fabric on which the most strict requirement is imposed among industrial fabrics, the present invention will hereinafter be described using the papermaking fabric as a representative example.

For papermaking fabrics, excellent surface property not permitting transfer of wire marks of the fabric to paper, dehydration property for sufficiently removing unnecessary water contained in the raw materials, fiber supporting property for supporting fine fibers, and rigidity permitting long-period running even under severe running conditions are very important. Research on the design or constitution of a fabric capable of satisfying the above-described properties is proceeding. Recently, two-layer fabrics using a warp binding yarn which functions as an upper surface side warp or lower surface side warp are known. The warp binding yarn has a binding function for weaving both an upper surface side weft and a lower surface side weft. At the same time, it has a function similar to that of an upper surface side warp or lower surface side warp constituting a portion of the upper side surface or lower side surface.

A two-layer fabric using a warp binding yarn is disclosed in Japanese Patent Laid-Open No. 2003-342889. This fabric has excellent surface property, because it uses a warp binding yarn and therefore does not use an additional binding yarn which destroys the upper surface side fabric design. In addition, it is superior in binding strength to a weft-bound fabric. In the fabric disclosed in this document, however, two warp binding yarns forming a pair pull an upper surface side weft to the lower side at a position where they pass over the upper surface side weft, resulting in the formation of a depressed portion on the upper side surface. A height difference therefore occurs between a knuckle formed by passing of an upper surface side warp, which is not involved in binding, over an upper surface side weft and a knuckle formed by passing of a warp binding yarn over an upper surface side weft and this sometimes remains as a mark on paper. In addition, warp binding yarns forming a pair adjacently cross each other in the fabric layer so that they may block an internal space in the layer and partially cause insufficient dehydration.

Thus, fabrics capable of satisfying all the properties that an industrial fabric is required to have such as dehydration property, surface property and rigidity have not yet been developed.

SUMMARY OF THE INVENTION

An object of the present invention is to provide an industrial two-layer fabric capable of satisfying all the properties that an industrial fabric must have such as dehydration property, surface property and rigidity.

The present invention relates to an industrial two-layer fabric having an upper side layer and a lower side layer. The upper side layer is comprised of an upper surface side warp that forms a warp design on an upper side surface and an upper surface side weft. The upper side layer is further comprised of a warp binding yarn for weaving an upper surface side weft and a lower surface side weft to bind the upper layer and the lower layer. The lower side layer is comprised of a lower surface side warp, a lower surface side weft and the warp binding yarn.

In a repeating unit of the industrial two-layer fabric, one upper surface side warp is disposed adjacent to three warp binding yarns each of which has a binding yarn design of passing over one or two successive upper surface side wefts to form a knuckle on the upper side surface. The three warp binding yarns appear on the upper side surface in turn, pass over respectively different upper surface side wefts, and form, on the upper side surface, knuckles between which at least one upper surface side weft exists. The three warp binding yarns get together and form, adjacent to the upper surface side warp, the warp design on the upper side surface.

At a portion in which one of the three warp binding yarns passes over one upper surface side weft, the other two warp binding yarns may pass under at least three upper surface side wefts including the one upper surface side weft.

In addition to the one upper surface side warp and the three warp binding yarns, one lower surface side warp that forms a warp pair with the one upper surface side warp may be arranged vertically below the one upper surface side warp. The three warp binding yarns may have the same design or different designs respectively.

The three warp binding yarns get together and form the warp design on the upper side surface, and may form on the upper side surface, woven together with the upper surface side warp and upper surface side weft, any one of a plain weave design, a twill weave design, a sateen weave design, a 1/4-1/2 design in which a warp passes over an upper surface side weft, passes under four successive upper surface side wefts, passes over an upper surface side weft and passes under two successive upper surface side wefts, or a 2/2 design in which a warp passes over two upper surface side wefts and passes under two upper surface side wefts.

The lower surface side weft may pass over two successive lower surface side warps and/or warp binding yarns and then pass under at least two successive lower surface side warps and/or warp binding yarns in the repeating unit. The lower surface side weft may pass over one lower surface side warp or warp binding yarn and then passes under at least two successive lower surface side warps and/or warp binding yarns.

The term such as "plain weave design" which is conventionally used for describing the design of a fabric means not only the design of a fabric but also the design of a yarn. For example, a warp which is woven with wefts and repeats a design of passing over a weft and then passing under a weft adjacent thereto is regarded to have a plain weave design.

The industrial two-layer fabric of the present invention has one upper surface side warp and three warp binding yarns adjacent thereto which get together to form on the upper side surface a design corresponding to a warp. Since the design and knuckle height of the fabric is uniform, the fabric has an excellent surface property. In addition, owing to existence of many spaces in the diagonal direction in the fabric layer compared with the conventional fabric, it has excellent breathability and water drainage property.

BRIEF DESCRIPTION OF THE DRAWINGS

FIGS. 19A and 19B include cross-sectional views taken along the line 19A-19A of a first binding warp pair 1 and along the line 19B-19B of a second binding warp pair 2 in FIG. 18 respectively.

FIG. 20 is a design diagram of an industrial two-layer fabric of Example 10 according to the present invention.

FIGS. 21A and 21B include cross-sectional views taken along the line 21A-21A of a first binding warp pair 1 and along the line 21B-21B of a second binding warp pair 2 in FIG. 20 respectively.

FIG. 22 is a design diagram of an industrial two-layer fabric of Example 11 according to the present invention.

Figure 1:
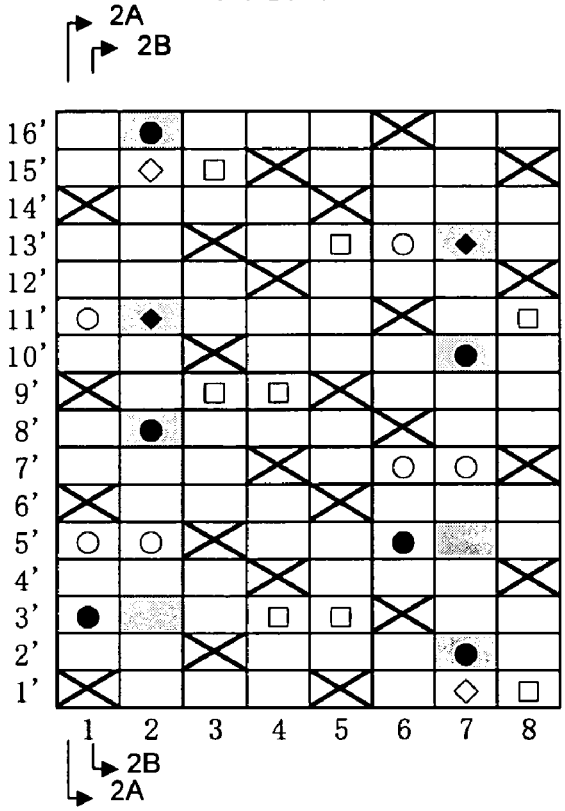
FIG. 1 is a design diagram of an industrial two-layer fabric of Example 1 according to the present invention.

In the drawings, numerals 1, 2, 3, . . . 10 denote pairs of binding warps or pairs of warps, and numerals 1' to 20' denote upper surface side wefts and lower surface side wefts.

DETAILED EXPLANATION OF THE INVENTION

The industrial two-layer fabric of the present invention has an upper surface side layer and a lower surface side layer. The upper surface side layer is composed of a warp binding yarn to be woven with both an upper surface side weft and a lower surface side weft to bind the upper and lower layers, an upper surface side warp and an upper surface side weft. The lower layer, on the other hand, is composed of a warp binding yarn, a lower surface side warp and a lower surface side weft. One upper surface side warp is disposed adjacent to three warp binding yarns. The warp binding yarns each has a design of passing over one or two successive upper surface side wefts to form a knuckle on the upper surface side. In addition, the three warp binding yarns appear on the upper side surface in turn; pass over respectively different upper surface side wefts; form knuckles on the upper side surface between which at least one upper surface side weft exists; and adjacent to the one upper surface side warp, get together to form on the upper surface side a design corresponding to a warp.

The term "three warp binding yarns get together" as used herein means that warps must usually be disposed at equal intervals, but owing to the action of a force attributable to the design, knuckles formed over upper surface side wefts by three warp binding yarns lie on a substantially a straight line. The action of this force will be described later in Examples.

The fabric of the present invention is a two-layer fabric using warp binding yarns. Since a longitudinal direction yarn (direction upon use of the fabric) is used for binding, the fabric is always used under tension and is therefore free from occurrence of internal wear which will otherwise be caused by loosening of upper and lower layers. Compared with an additional binding yarn used only for binding, the warp binding yarns serve as a warp forming a surface and do not generate additional marks. In addition, since no additional binding yarn is used, the shooting number can be increased. The fabric has therefore an excellent fiber supporting property.

In the conventional fabrics, a space inside thereof is blocked by two adjacent warp binding yarns crossing each other and their breathability and water drainage property are insufficient. In the fabric of the present invention, on the other hand, three warp binding yarns appear on the upper side surface in turn and when a warp binding yarn passes over an upper surface side weft, the other two warp binding yarns exist between the upper surface side weft and a lower surface side weft or under the lower surface side weft. Owing to diagonal spaces which have appeared among these three warp binding yarns, the fabric has an excellent water drainage property and breathability.

The term "knuckle" as used herein means a winded and protruded portion formed on the upper side surface or lower side surface by passing of an upper surface side warp, a warp binding yarn or a lower surface side warp over or under one or two wefts to interweave therewith and it is formed over an upper surface side weft in the upper surface side layer and under a lower surface side weft in the lower surface side layer. An upper surface side warp is woven with an upper surface side weft to form an upper side surface design. A warp binding yarn is woven with both an upper surface side weft and a lower surface side weft to constitute a portion of the upper side surface design and a portion of the lower side surface design. Three warp binding yarns which are adjacent to one another get together to form on the upper side surface a design corresponding to an upper surface side warp. The warp binding yarn also functions as a binding yarn for weaving the upper layer with the lower layers.

The fabric of the present invention is obtained by disposing one upper surface side warp adjacent to three warp binding yarns. In addition to these warps, a warp pair composed of an upper surface side warp to be woven with an upper surface side weft and a lower surface side warp to be woven with a lower surface side weft may be disposed. A warp binding yarn is necessary for weaving upper and lower layers and a fabric must have at least one set in its repeating unit or complete design. An increase of a proportion of warp binding yarns leads to an improvement of binding power but disposal of at least one set in a repeating unit or a complete design is sufficient. The "one set" contains one upper surface side warp and three warp binding yarns which are adjacent to each other. The term "two sets" means the above-described set and another set. When the number of the sets increases, the number of warp binding yarns increases, which leads to improvement in the binding strength of the upper and lower layers. In a 16-shaft complete design, for example, it is only necessary to dispose a set of one upper surface side warp and three warp binding yarns and, as the remaining warps, warp pairs. In short, the fabric is composed of one set and six warp pairs. When the number of the set is increased to two, four warp pairs are disposed. When the number of the sets is three, two warp pairs are disposed. When the number of the set is four, no warp pair exists so a lower surface side warp is not disposed. It is needless to say that no limitation is imposed on the number of shafts and it can be increased to 20, 24 or the like. The set and the warp pair may also be disposed at any ratio.

The term "shaft" means the number of heddles for lifting up and down yarns constituting a repeating unit or a complete design and the term "the number of shafts" means the number of warps constituting the complete design. For example, a two-layer fabric having a complete design formed by eight upper surface side warps and eight lower surface side warps is a 16-shaft fabric.

In the present invention, one upper surface side warp is disposed adjacent to three warp binding yarns. In addition to this absolute requirement, these three warp binding yarns must be adjacent to one another. For example, three warp binding yarns never have an upper surface side warp among them because these three warp binding yarns get together to form a surface design similar to that of the one upper surface side warp. For this purpose, the three warp binding yarns are required to be disposed adjacent to one another. In addition, adjacent to the three warp binding yarns, the one upper surface side warp must be disposed and the number of this upper surface side warp cannot be increased to two because of the weaving problem. The fabric of the present invention essentially has, as a warp pair, an upper surface side warp and a lower surface side warp arranged vertically below the upper surface side warp. The one upper surface side warp and three warp binding yarns adjacent thereto are substituted for two upper surface side warps and two lower surface side warps which will otherwise be disposed. A combination of three warp binding yarns alone or a combination of three warp binding yarns and two upper surface side warps cannot be substituted for two upper surface side warps and two lower surface side warps. A warp binding yarn is disposed at a position where an upper surface side warp or lower surface side warp must originally be disposed. The number of a warp binding yarn must therefore be determined depending on the number of the upper surface side warp or lower surface side warp, which is known to those skilled in the art. With regard to the one upper surface side warp and three warp binding yarns in the present invention, the upper surface side warp and one of the warp binding yarns are overlapped and illustrated as a row and the other two warp binding yarns are overlapped and illustrated as a row, each in the design diagrams of Examples which will be shown in later. They are illustrated in a similar manner to that conventionally employed for the illustration of an upper surface side warp and a lower surface side warp. Respective replacement of an upper surface side warp and a lower surface side warp with warp binding yarns facilitates understanding. In an actual fabric, however, their rows are not arranged at equal intervals. Some get together and some are separated from each other.

Each warp binding yarn has a design of passing over one or two successive upper surface side wefts to form a knuckle on the upper side surface. The three warp binding yarns do not necessarily have the same design and they may be respectively different. In particular, they preferably have the same design or mirror-image designs which are left-right reversal each other, because their downward pulling strength of an upper surface side weft becomes constant, making it possible to form, on the surface, knuckles having a uniform height, and because tension balance between them during weaving becomes almost equal, which facilitates adjustment during weaving and eliminates the need for increasing the number of beams of a weaving machine.

It is also preferred to employ the same design for two of the three warp binding yarns and a different design for the remaining one warp binding yarn. These three warp binding yarns are designed to appear on the upper side surface in turn and pass over respectively different upper surface side wefts.

The three warp binding yarns get together to form a surface design similar to that of the one upper surface side warp with the proviso that at least one upper surface side weft exists between knuckles formed on the upper side surface by these three warp binding yarns. At a portion where one of the warp binding yarn passes over an upper surface side weft, the other two warp binding yarns have preferably a design of passing under at least three upper surface side wefts including the above-described upper surface side weft in order to bring the three warp binding yarns close to each other and allow them to function as one upper surface side warp. Supposing that two of the three warp binding yarns have a design of passing over two, adjacent upper surface side wefts, adjacent knuckles of warp binding yarns act repulsively, are separated and do not seem to be a warp owing to the action of a force such as a pulling force or pulled force in the longitudinal direction or vertical direction caused by the upward and downward movements of warps, or a structural force caused by the upward and downward movements of wefts resulting from the above-described force of warps. When the knuckles formed by the three warp binding yarns gather in one line to show as if one upper surface side warp forms these knuckles one after another on the upper surface side warp, it is important to locate knuckles apart from each other.

At a portion where one of the three warp binding yarns passes over an upper surface side weft, the other two exist under the upper surface side weft, more specifically, between the upper surface side weft and a lower surface side weft or under the lower surface side weft. The upper surface side weft is therefore pushed upward by them and is prevented from being pulled down at the portion where the warp binding yarn passes over the weft. This reduces a height difference between knuckles formed on the upper side surface by the warp binding yarns and knuckles formed by the upper surface side warp, whereby knuckles having a uniform height are formed on the upper side surface.

Similarly, at the portion where one of the three warp binding yarns passes over an upper surface side weft, the other two warp binding yarns exist under the upper surface side weft, more specifically, between the upper surface side weft and a lower surface side weft or under the lower surface side weft. Water drainage spaces penetrating through the fabric in random diagonal directions are therefore formed, whereby the resulting fabric has an excellent water drainage property.

The design of the three warp binding yarns will next be described in detail. For example, three warp binding yarns are brought close to each other to form a 1/3 design in which any one of them passes over an upper surface side weft and passes under three successive upper surface side wefts. The 1/3 design is formed, for example, by causing any one of the three warp binding yarns to pass over the 4-th, 8-th, 12-th and 16-th upper surface side wefts. Then, one of them passes over the 4-th and 12-th upper surface side wefts, one of the remaining two passes the 8-th upper surface side weft, and the last one passes over the 16-th upper surface side weft. It is needless to say that what warp binding yarn passes over what weft can be selected as needed. Since any one of these three warp binding yarns must be woven with both an upper surface side weft and a lower surface side weft, it must pass under at least one lower surface side weft at a portion where it does not pass over an upper surface side weft. Adjacent to these three warp binding yarns, one upper surface side warp lies while repeating a design of passing over an upper surface side weft and then passing under three successive upper surface side wefts.

No particular limitation is imposed on the design formed on the upper side surface. The design is, for example, a 1/4-1/2 design in which a warp passes over an upper surface side weft, passes under four successive upper surface side wefts, passes over an upper surface side weft and passes under two upper surface side wefts. In addition, a plain weave design in which a warp alternately passes over and under wefts, a twill weave design obtained by shifting, by one weft, a 1/3 design in which a warp passes over a weft and then passes under three wefts, or a sateen weave design obtained by irregularly shifting the 1/3 design can be employed. The upper surface side warp constitutes such a design by itself so the design can be employed as is, but it is necessary to take due consideration of the design and combination of the designs of three warp binding yarns when they adopt such a design.

No particular limitation is imposed on the lower side surface design. For example, preferred is a design in which a lower surface side weft passes over two successive lower surface side warps and/or warp binding yarns and then passes under two or more successive lower surface side warps and/or warp binding yarns to form a long crimp of the lower surface side weft on the lower side surface. In particular, at a portion of the three warp binding yarns, it is possible for two of them to alternately have a design similar to that of a lower surface side warp and for the remaining one to have a design similar to that of a lower surface side warp. Anyway, the design must be determined after consideration of the relation with the upper side surface design.

By employing a design in which two adjacent warps on the lower surface side simultaneously weave a lower surface side weft, the long crimp of lower surface side weft protrudes more from the surface, which improves both wear resistance and at the same time improves rigidity. When a warp and a warp right-hand adjacent thereto simultaneously weave a lower surface side weft from the lower side, and then the warp and a warp left-hand adjacent thereto simultaneously weave another lower surface side weft from the lower side, the warps on the lower surface side snake their way and forms zigzag arrangement. Owing to such a design, the fabric has improved rigidity in the diagonal direction. Moreover, owing to existence of both an overlap portion and a non-overlap portion between a warp on the upper surface side and a warp on the lower surface side, meshes with a random size or shape can be formed, which enables stepwise dehydration. This makes it possible to prevent generation of dehydration marks, sticking of a sheet raw material onto a wire or loss of fiber or filler from the wire.

Two warps on the lower surface side which are adjacent to each other may have a design of passing over and under the same upper surface side wefts to form a long crimp of a lower surface side weft.

No particular limitation is imposed on the arrangement ratio of upper surface side wefts and lower surface side wefts. It is preferred that in the papermaking fabric, the upper side surface is made dense from the standpoints of fiber supporting property and surface property and the lower side surface is made rough because wefts having a larger diameter are preferably used in order to improve wear resistance. For example, upper surface side wefts and lower surface side wefts are arranged at a ratio of 2:1, 4:3, 3:2 or the like. They may of course be arranged at a ratio of 1:1.

On the upper side surface, auxiliary wefts smaller in diameter than upper surface side wefts may be placed between upper surface side wefts. For example, an upper surface side weft and an auxiliary weft are arranged alternately to form a long crimp of the auxiliary weft passing over a plurality of warps. Such a design is effective for improving the fiber supporting property of wefts.

Although no particular limitation is imposed on the diameter of constituent yarns, upper surface side wefts and upper surface side warps constituting the upper side surface preferably have a relatively smaller diameter in order to obtain a dense and smooth surface. For applications requiring a good surface property, use of warp binding yarns having an equal diameter to upper surface side warps is preferred. A difference in diameter between upper surface side warps and warp binding yarns is not preferred because yarns having a larger diameter may protrude from the upper side surface and give wire marks to paper. When upper surface side warps and warp binding yarns have an equal diameter, warp knuckles on the upper side have almost an equal height, making it possible to form a relatively uniform surface. Warp binding yarns and lower surface side warps may have the same diameter when wear resistance is an important factor.

The lower side surface which will be brought into contact with a machine or roll requires rigidity and wear resistance so that lower surface side wefts and lower surface side warps have preferably a relatively large diameter.

Yarns to be used in the present invention may be selected depending on the using purpose. Examples of them include, in addition to monofilaments, multifilaments, spun yarns, finished yarns subjected to crimping or bulking such as so-called textured yarn, bulky yarn and stretch yarn, and yarns obtained by intertwining them. As the cross-section of the yarn, not only circular form but also square or short form such as stellar form, or elliptical or hollow form can be used. The material of the yarn can be selected freely and usable examples of it include polyester, polyamide, polyphenylene sulfide, polyvinylidene fluoride, polypropylene, aramid, polyether ether ketone, polyethylene naphthalate, polytetrafluoroethylene, cotton, wool and metal. Of course, yarns obtained using copolymers or incorporating or mixing the above-described material with a substance selected depending on the intended purpose may be used.

As upper surface side warps, lower surface side warps, warp binding yarns and upper surface side wefts of a paper making wire, polyester monofilaments having rigidity and excellent size stability are usually suited. As lower surface side wefts which require wear resistance, those obtained by interweaving a polyester monofilament and a polyamide filament, for example, by disposing them alternately are preferred because the fabric using such a weft has improved wear resistance while maintaining rigidity.

EXAMPLES

Examples of the present invention will next be described based on accompanying drawings. The description can also be applied to another warp row and is common in all the design diagrams.

For convenience of the design diagrams, a warp 1 represents an upper surface side warp 1 and a warp binding yarn 1, and a warp 2 adjacent to the warp 1 represents two warp binding yarns.

With regard to a warp pair, an upper surface side warp and a lower surface side warp are shown in a row.

Figure 2A:
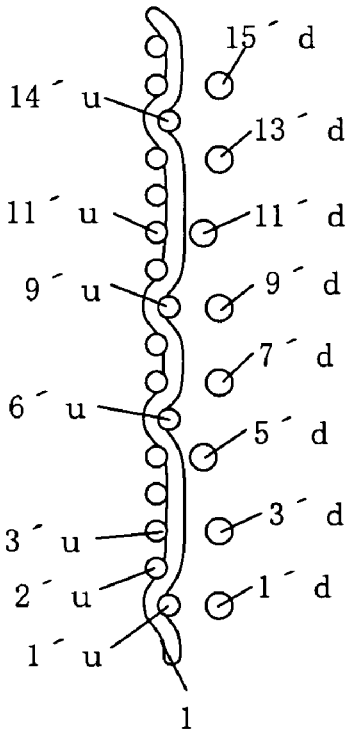
FIGS. 2A and 2B include cross-sectional views taken along the line 2A-2A of a first binding warp pair 1 and long the line 2B-2B of a second binding warp pair 2 in FIG. 1 respectively.
Figure 2B:
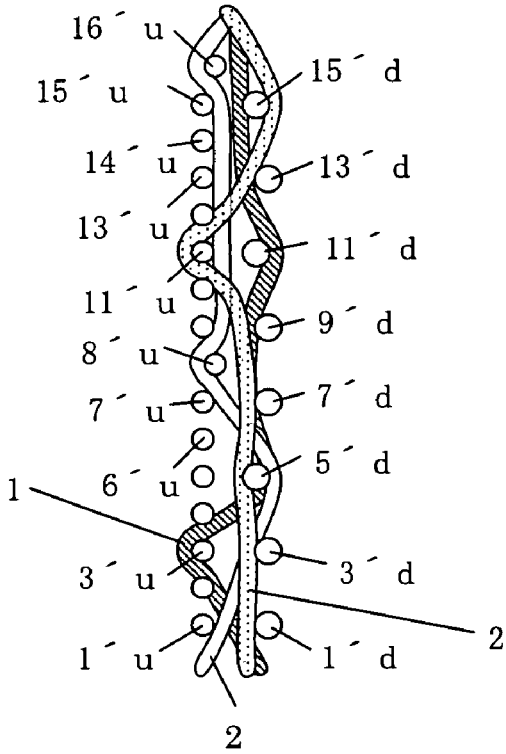
Figure 3:
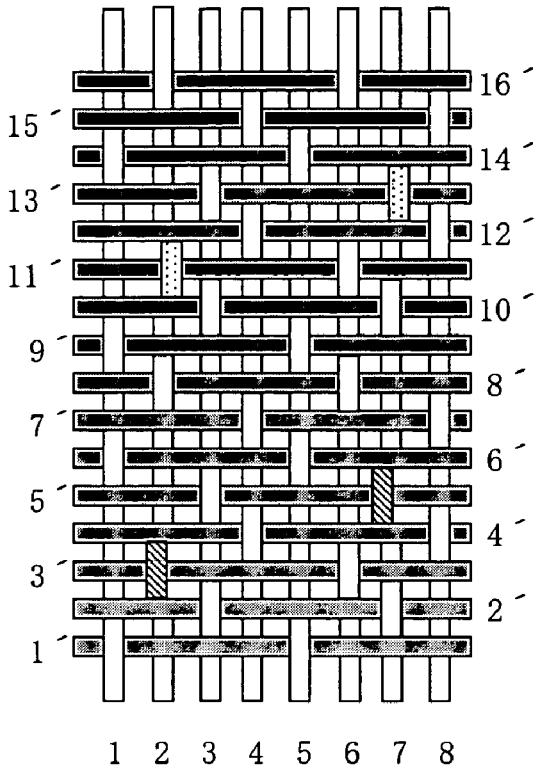
FIG. 3 is a plain view illustrating the upper side surface of FIG. 1.

FIGS. 1 to 23B are design diagrams or cross-sectional views taken along warps illustrating examples of the present invention. FIG. 3 is a plan view of the upper surface side of the design diagram of Example 1.

A design diagram is a minimum repeating unit of a fabric design and a whole fabric design is formed by connecting this complete design longitudinally and latitudinally. In the design diagram, warps are indicated by Arabic numerals, for example 1, 2 and 3, of which some are pairs of warps composed of an upper surface side warp and a lower surface side warp, some are pairs of an upper surface side warp and a warp binding yarn, and some are pairs of two binding warps. Wefts are indicated by Arabic numerals with a prime, for example, 1', 2' and 3'. In particular, upper surface side wefts are indicated by attaching "u" thereto, for example, 1'*u*, 2'*u* and 3'*u*, while lower surface side wefts are indicated by attaching "d", for example 1'*d*, 2'*d* and 3'*d*. Some of the wefts have an upper surface side weft and a lower surface side weft stacked vertically and some are composed only of an upper surface side weft, which is determined depending on the arrangement ratio.

In these diagrams, a mark "x" means that an upper surface side warp lies over an upper surface side weft; a mark "□" indicates that a lower surface side warp lies under a lower surface side weft; a mark "●" indicates that a warp binding yarn lies over an upper surface side weft; a mark "○" indicates that a warp binding yarn lies under a lower surface side weft; a mark "◆" indicates that a warp binding yarn lies over an upper surface side weft; and a mark "◇" indicates that a warp binding yarn lies under a lower surface side weft.

In the design diagrams, yarns are vertically overlapped precisely. They are however illustrated as such for convenience of drawing and misalignment sometimes occurs in the actual fabric. With regard to wefts, some upper surface side wefts do not have a lower surface side weft thereunder because of the arrangement ratio.

In particular, in the design diagram, a positional relationship between one upper surface side warp and three warp binding yarns is indicated by disposing a pair of an upper surface side warp and a warp binding yarn adjacent to a pair of two warp binding yarns. It cannot be understood from the design diagram that these three warp binding yarns get together, but can be understood from the cross-sectional views taken along warps and the plan view of the upper side surface.

Example 1

FIG. 1 is a design diagram of a fabric of Example 1 of the present invention. FIGS. 2A and 2B include cross-sectional views taken along the line 2A-2A of an upper surface side warp 1 and that of a warp binding yarn 1 and a cross sectional view taken along the line 2B-2B of two warp binding yarns 2 respectively, each illustrated in the design diagram of FIG. 1. FIG. 3 is a plan view, viewed from the upper surface side, of a fabric woven based on the design diagram of FIG. 1. For convenience of explanation, indicated at numeral 1 in the design diagram of FIG. 1 are both warp 1 and warp binding yarn 1, which is also applicable to numeral 6. Warp 2 means two warp binding yarns, which is also applicable to warp 7. This fabric is a 16-shaft two-layer fabric having two sets of one upper surface side warp and three warp binding yarns. Warps 1 and 2 constitute one set, while warps 6 and 7 constitute another one set. The other warps 3, 4, 5 and 8 are each a warp set composed of an upper surface side warp and a lower surface side warp. Upper surface side wefts and lower surface side wefts are arranged at a ratio of 2:1.

In the design diagram of FIG. 1, on the upper side surface, a warp has a 1/4-1/2 design in which it passes over an upper surface side weft, passes under four successive upper surface side wefts, passes over an upper surface side weft and passes under two upper surface side wefts, while an upper surface side weft repeats a design in which it passes under an upper surface side warp or warp binding yarn and passes over three upper surface side warps and/or warp binding yarns. Described specifically, on the upper side surface, an upper surface side warp 1 repeats a 1/4-1/2 design in which it passes over an upper surface side weft 1'*u*, passes under four successive upper surface side wefts 2'*u*, 3'*u*, 4'*u* and 5'*u*, passes over an upper surface side weft 6'*u*, passes under two upper surface side wefts 7'*u* and 8'*u*, passes over an upper surface side weft 9'*u*, passes under four successive upper surface side wefts 10'*u*, 11'*u*, 12'*u* and 13'*u*, passes over an upper surface side weft 14'*u* and passes under two upper surface side wefts 15'*u* and 16'*u*.

The design formed on the upper side surface by the three warp binding yarns which get together is also a 1/4-1/2 design. As can be understood from the cross-sectional views of FIG. 2A taken along warps, the warp binding yarn 1 marked with diagonal lines passes over the upper surface side weft 3'*u*, and then passes under the lower surface side wefts 5'*d* and 11'*d*. The warp binding yarn 2 in FIG. 2B with no mark has a design in which it passes under the lower surface side weft 5'*d* and then passes over the upper surface side wefts 8'*u* and 16'*u*. The warp binding yarn 2 marked with dots has a design in which it passes over the upper surface side weft 11'*u* and then passes under the lower surface side weft 15'*d*. In any one of these three designs, a warp binding yarn passes over an upper surface weft at which the other two warp binding yarns exist under the upper surface side weft and knuckles formed by respective warp binding yarns on the upper side surface are separated from each other by two or four wefts. Thus, it is possible to put knuckles formed by three warp binding yarns on one line without causing repulsion among them by employing a design in which at least one upper surface side weft exists between two knuckles formed over the upper side surface by three warp binding yarns. As a result, an upper surface side warp seems to form knuckles one after another on the upper side surface.

At a binding portion where a warp binding yarn passes over an upper surface side weft, it has a force to pull down the upper surface side weft, but in the present invention, at that portion, the other two warp binding yarns pass under the upper surface side weft to support it from below so that no recess appears at the binding portion and knuckles have a uniform height.

In the plan view of FIG. 3, the upper surface side warp 1, a warp design formed by the three warp binding yarns and an upper surface side warp 3 are arranged at almost equal intervals. A description will next be made of this structure.

First, the reason why two warp binding yarns 2 get together will be described. The upper side knuckles of one of these warp binding yarns are indicated by ● and they are formed over the upper surface side wefts 8'*u* and 16'*u*. The upper side knuckles of the upper surface side warp 1 which is in a row adjacent to the warp binding yarns are indicated by x and they are formed over the upper surface side wefts 1'*u*, 6'*u*, 9'*u* and 14'*u*. The knuckle ● over the upper surface side weft 8'*u* acts repulsively with the contiguous knuckle x of the upper surface side warp 1 over the upper surface side weft 9'*u*, and tends to move in the right direction. Similarly, the knuckle over the upper surface side weft 16'*u* also tends to move in the right direction, affected by the contiguous knuckle of the upper surface side warp 1 over the upper surface side weft 1'*u*.

An upper side knuckle ♦ of the other warp binding yarn 2 is also formed over the upper surface side weft 11'*u*. Upper surface side knuckles of the upper surface side warp 3 which exists in an adjacent row are indicated by x and they are formed over the upper surface side wefts 2'*u*, 5'*u*, 10'*u* and 13'*u*. The knuckle ♦ over the upper surface side weft 11'*u* therefore acts repulsively with the contiguous knuckle of the upper surface side warp 3 over the upper surface side weft 10'*u* and tends to move in the left direction. By such tendencies, these two warp binding yarns get together almost at the center of the upper surface side warp 1 and upper surface side warp 3, whereby the knuckles lie on a substantially a straight line.

These two warp binding yarns 2 and warp binding yarn 1 get together because of the following reason. The warp binding yarn 1, which is adjacent to the warp binding yarns 2, forms a knuckle over the upper surface side weft 3'*u*. Since two warp binding yarns 2 do not form an upper side knuckle between the upper surface side wefts 1'*u* and 7'*u* so that a space exists on the upper surface side. The warp binding yarn 1 tends to move toward the warp binding yarns 2 in order to fill the space. A knuckle formed, over the upper surface side weft 4'*u*, by an upper surface side warp 8 which exists in a row adjacent to the warp binding yarn 1 has also an influence on this movement. Similar to the above-described phenomenon, a knuckle ● over the upper surface side weft 3'*u* acts repulsively with the contiguous knuckle of the upper surface side warp 8 over the upper surface side weft 4'*u* and tends to move in the right direction. By this, the knuckle of the warp binding yarn 1 seems to be taken in two warp binding yarns 2, whereby the knuckle seems to be formed on a straight line of a warp by these three warp binding yarns. At the same time, these three warp binding yarns, like three upper surface side warps, are arranged at equal intervals. This also applies to other combinations of one upper surface side warp and three warp binding yarns adjacent thereto.

Thus, the warp binding yarn 1 and two warp binding yarns 2 repeat a 1/4-1/2 design on the upper side surface, that is, passing under two upper surface side wefts 1'*u* and 2'*u*, passing over an upper surface side weft 3'*u*, passing under four successive upper surface side wefts 4'*u*, 5'*u*, 6'*u* and 7'*u*, passing over an upper surface side weft 8'*u*, passing under two upper surface side wefts 9'*u* and 10'*u*, passing over an upper surface side weft 11'*u*, passing under four successive upper surface side wefts 12'*u*, 13'*u*, 14'*u* and 15'*u*, and then passing over an upper surface side weft 16'*u*. In short, the three warp binding yarns cooperatively constitute on the upper side surface a 1/4-1/2 design similar to that of the upper surface side warp 1.

At a portion where one of the warp binding yarns passes over an upper surface side weft, the other two warp binding yarns lie under the upper surface side weft, which means that they lie between the upper surface side weft and a lower surface side weft or lie under the lower surface side weft so that water drainage spaces penetrating through the fabric in random oblique directions are formed, whereby the resulting fabric has an excellent water drainage property.

As is apparent from the warp 1 of FIG. 1, on the lower side surface, a warp on the lower side passes under a lower surface side weft 5'*d*, passes over 7'*d* and 9'*d*, passes under 11'*d* and passes over 13'*d*, 15'*d*, 1'*d* and 3'*d*. In short, it passes over four lower surface side wefts, passes under a lower surface side weft, passes over two lower surface side wefts and passes under a lower surface side weft, thus exhibiting a 4/1-2/1 design. A lower surface side weft passes over two adjacent warps on the lower side and then passes under six successive warps on the lower side to form a weft long crimp on the lower side surface. The fabric having excellent wear resistance can be obtained by employing a design of forming a weft long crimp on the lower side surface. With regard to a warp on the lower side, two warp binding yarns, as a pair, form a lower surface side warp design corresponding to a warp, a warp binding yarn forms a lower surface side warp design corresponding to a warp, or a lower surface side warp forms a warp design. For example, the warp binding yarn 1 of FIG. 1 is woven with a lower surface side weft to form a design corresponding to a lower surface side warp on the lower surface side. Two warp binding yarns 2 alternately pass under lower surface side wefts to form a design corresponding to a lower surface side warp. A lower surface side warp 3 is woven with a lower surface side weft to form a design corresponding to a lower surface side warp. In such a manner, long crimps of the lower surface side weft equal in length can be formed on the lower side surface.

Lower surface side wefts are woven from the lower side by two adjacent warps so that the resulting fabric has improved rigidity. In addition, a wear-resistant volume increases due to the protrusion of a long crimp on the lower side surface so that the resulting fabric has excellent wear resistance. Moreover, a zigzag arrangement in which at a portion where a warp constituting the lower side surface weaves therein a lower surface side weft from the lower side, it alternately approaches warps which are adjacent to each other on right and left sides is employed so that warps travel while winding their way to the left and right and the resulting fabric has improved rigidity in the diagonal direction. Owing to the existence of both an overlap portion and a non-overlap portion between a warp on the upper surface side with a warp on the lower surface side, meshes with a random size or shape can be formed and stepwise dehydration can therefore be carried out. This makes it possible to prevent generation of dehydration marks, sticking of a sheet raw material onto a wire or loss of fiber or filler from the wire.

For example, a lower surface side warp 4, together with a lower surface side warp 5 which is on the right adjacent thereto, forms a knuckle under the lower surface side weft 3'*d* and then, together with a lower surface side warp 3 which is on the left adjacent to the lower surface side warp 4, forms a knuckle under the lower surface side weft 9'*d*. The lower surface side warp 4 then moves to the right side at the intersection with the lower surface side weft 3'*d* and moves to the left side at the intersection with the lower surface side weft 9'*d*. Thus, it has zigzag arrangement. Neither upper surface side warps nor warp binding yarns employ a design of zigzag arrangement different from the warps on the lower surface side. Warps on the upper side and warps on the lower side overlap at some portions but do not overlap at some portions. Dehydration holes penetrating through the fabric from the upper side to the lower side therefore do not have a uniform shape, making it possible to prevent drastic dehydration. The lower surface side warp 4 was so far described, but the other lower surface side warps and warp binding yarns have a similar random structure, which makes it possible to obtain a fabric having, as a whole, a uniform surface property.

Example 2

Figure 4:
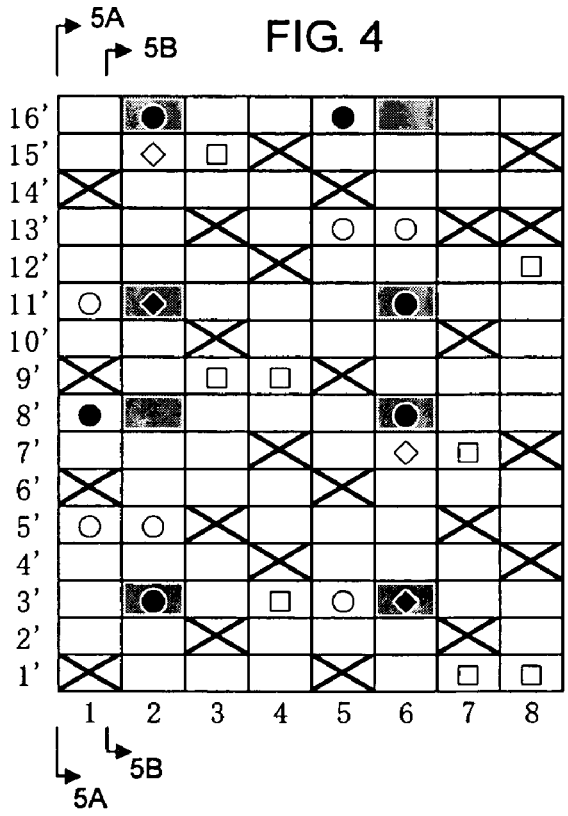
FIG. 4 is a design diagram of an industrial two-layer fabric of Example 2 according to the present invention.
Figure 5A:
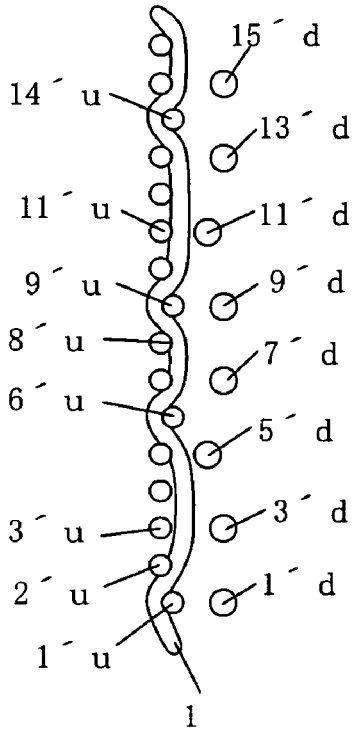
FIGS. 5A and 5B include cross-sectional views taken along the line 5A-5A of a first binding warp pair 1 and along the line 5B-5B of a second binding warp pair 2 in FIG. 4 respectively.
Figure 5B:
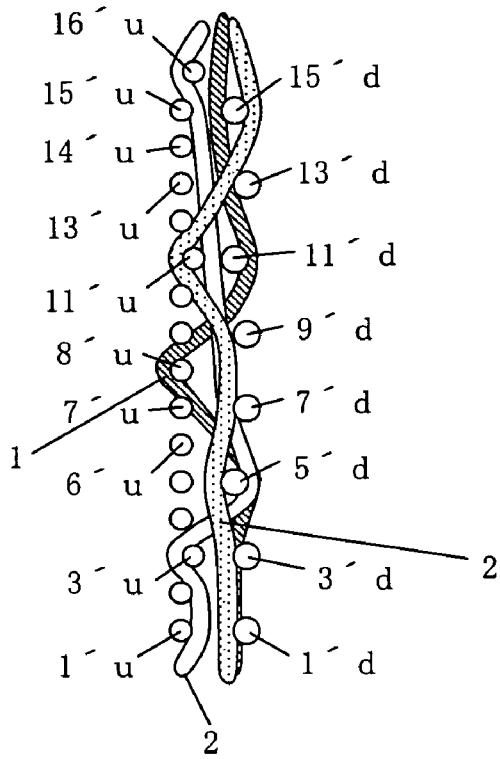

FIG. 4 is a design diagram of a fabric of Example 2 according to the present invention. FIGS. 5A and 5B include cross-sectional views of an upper surface side warp 1 and that of a warp binding yarn 1 and two warp binding yarns 2, each illustrated in the design diagram of FIG. 4, and these three warp binding yarns get together and form a design corresponding to a warp on the upper side surface. In the design diagram of FIG. 4, indicated at numerals 1 and 5 are pairs of an upper surface side warp and a warp binding yarn, indicated at numerals 2 and 6 are pairs of two warp binding yarns, and indicated at numerals 3, 4, 7 and 8 are pairs of an upper surface side warp and a lower surface side warp.

The upper side surface is composed of warps having a 1/4-1/2 design and wefts having a 1/3 design, as in Example 1. Each of the warp binding yarn 1 and two warp binding yarns 2 does not constitute a 1/4-1/2 design on the upper side surface, but they get together and cooperatively form a 1/4-1/2 design similar to that of the upper surface side warp 1 on the upper side surface. The upper side surface design and lower side surface design are similar to those of Example 1, but the design of warp binding yarns constituting them is different.

At a portion where a warp binding yarn passes over an upper surface side weft, it tends to pull the upper surface side weft downward. In the present invention, however, at that portion, another warp binding yarn passes under the upper surface side weft to support the upper surface side weft from the lower side so that no recess appears at a binding portion and the knuckles have a uniform height. Moreover, at a portion where a warp binding yarn passes over an upper surface side weft, the other two warp binding yarns lie under the upper surface side weft, which means that they lie between the upper surface side weft and a lower surface side weft or lie under the lower surface side weft so that water drainage spaces penetrating through the fiber in random oblique directions are formed, whereby the resulting fabric has an excellent water drainage property. In addition, a warp binding yarn is a longitudinal direction yarn onto which a tension is applied so that it has an excellent binding power. Since no additional binding yarn exists, the upper side surface design becomes uniform without being disturbed by it.

On the lower side surface, a 4/1-2/1 design similar to that of Example 1 is formed. A lower surface side weft has a design in which it passes over two adjacent warps on the lower surface side and passes under six successive warps on the lower surface side to form a weft long crimp on the lower side surface. Rigidity in the diagonal direction is improved owing to the zigzag arrangement employed for lower surface side warps. Both an overlap portion and a non-overlap portion appear between warps on the upper surface side and warps on the lower surface side. Meshes with a random size or shape are therefore formed so that stepwise dehydration can be carried out. This makes it possible to prevent generation of dehydration marks, sticking of a sheet raw material onto a wire or loss of fiber or filler from the wire.

Example 3

Figure 6:
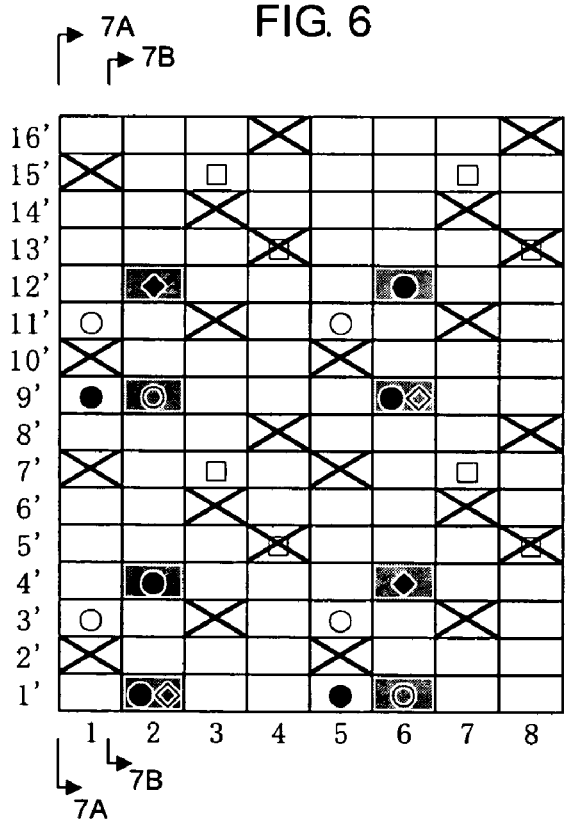
FIG. 6 is a design diagram of an industrial two-layer fabric of Example 3 according to the present invention.
Figure 7A:
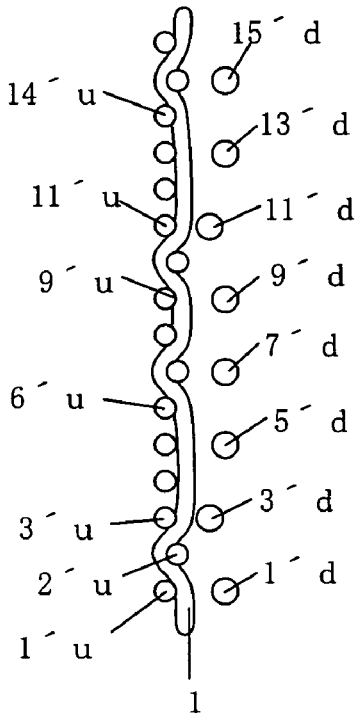
FIGS. 7A and 7B include cross-sectional views taken along the line 7A-7A of a first binding warp pair 1 and along the line 7B-7B of a second binding warp pair 2 in FIG. 6 respectively.
Figure 7B:
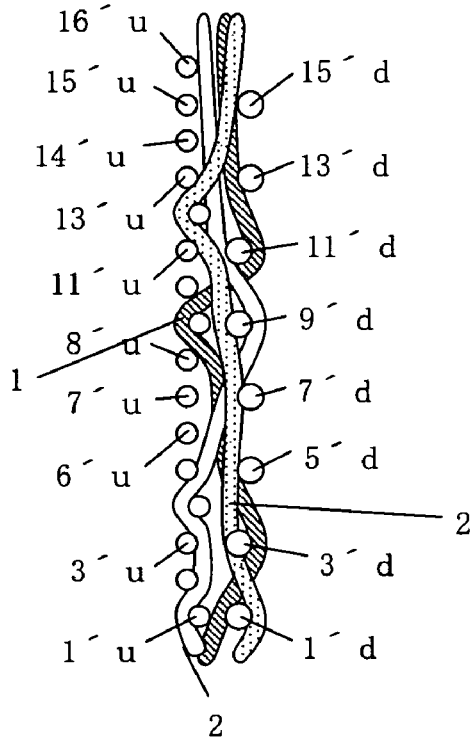

FIG. 6 is a design diagram of a fabric of Example 3 according to the present invention. FIGS. 7A and 7B include cross-sectional views of an upper surface side warp 1 and that of a warp binding yarn 1 and two warp binding yarns 2, each illustrated in the design diagram of FIG. 6. These three warp binding yarns get together and form a design corresponding to a warp on the upper side surface. In the design diagram of FIG. 6, indicated at numerals 1 and 5 are pairs of an upper surface side warp and a warp binding yarn, indicated at numerals 2 and 6 are pairs of two warp binding yarns, and indicated at numerals 3, 4, 7 and 8 are pairs of an upper surface side warp and a lower surface side warp.

The upper side surface is composed of warps having a 1/4-1/2 design and wefts having a 1/3 design, as in Example 1. Each of the warp binding yarn 1 and two warp binding yarns 2 does not constitute a 1/4-1/2 design on the upper side surface, but they get together and cooperatively form a 1/4-1/2 design similar to that of the upper surface side warp 1 on the upper side surface. The fabric of this Example is similar to that of Example 1 or 2 in the upper side surface design, but different in the lower side surface design.

At a portion where a warp binding yarn passes over an upper surface side weft, it tends to pull the upper surface side weft downward. In the present invention, however, at that portion, another warp binding yarn passes under the upper surface side weft to support the upper surface side from the lower side so that no recess appears at the binding portion and the knuckles have a uniform height. Moreover, at a portion where a warp binding yarn passes over an upper surface side weft, the other two warp binding yarns lie under the upper surface side weft, which means that they lie between the upper surface side weft and a lower surface side weft or lie under the lower surface side weft so that water drainage spaces penetrating through the fabric in random oblique directions are formed, whereby the resulting fabric has an excellent water drainage property. In addition, a warp binding yarn is a longitudinal direction yarn onto which a tension is applied so that it has an excellent binding power. Since no additional binding yarn exists, the upper side surface design becomes uniform without being disturbed by it.

On the lower side surface, a lower surface side warp passes under a lower surface side weft and then passes over three successive lower surface side wefts. A lower surface side weft passes over a warp on the lower surface side, passes under three successive warps on the lower surface side, passes over a warp on the lower surface side and then passes under three successive warps on the lower surface side, thereby forming a weft long crimp on the lower side surface. The design on the lower side surface has therefore excellent wear resistance.

Example 4

Figure 8:
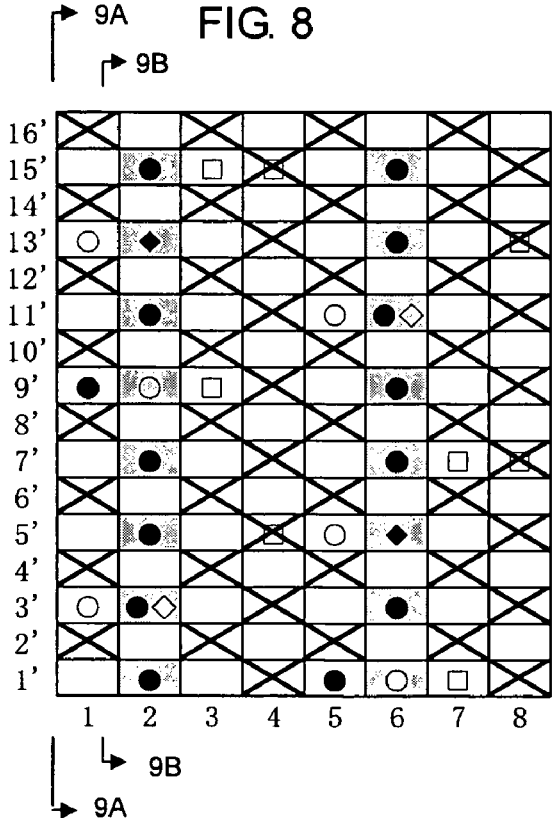
FIG. 8 is a design diagram of an industrial two-layer fabric of Example 4 according to the present invention.
Figure 9A:
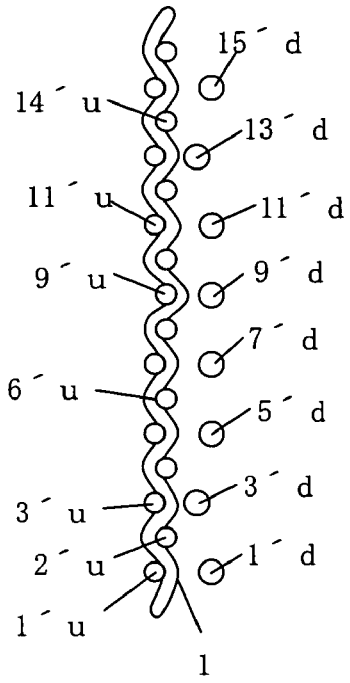
FIGS. 9A and 9B include cross-sectional views taken along the line 9A-9A of a first binding warp pair 1 and along the line 9B-9B of a second binding warp pair 2 in FIG. 8 respectively.
Figure 9B:
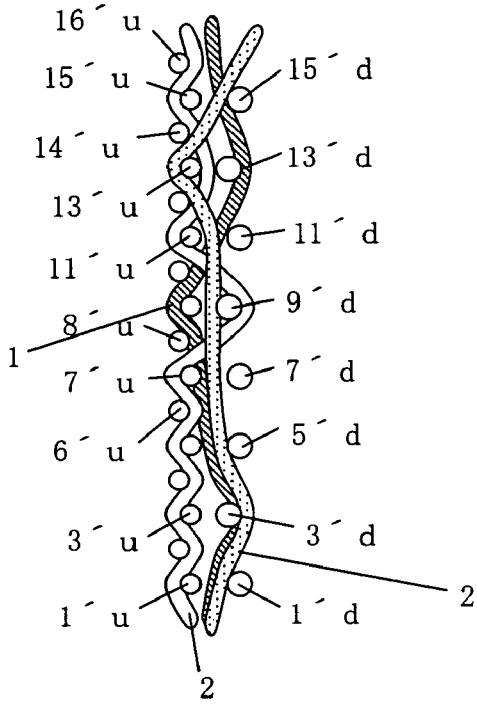

FIG. 8 is a design diagram of a fabric of Example 4 according to the present invention. FIGS. 9A and 9B include cross-sectional views of an upper surface side warp 1 and that of a warp binding yarn 1 and two warp binding yarns 2, each illustrated in the design diagram of FIG. 8. These three warp binding yarns get together and form a design corresponding to a warp on the upper side surface.

In the design diagram of FIG. 8, indicated at numerals 1 and 5 are pairs of an upper surface side warp and a warp binding yarn, indicated at numerals 2 and 6 are pairs of two warp binding yarns, and indicated at numerals 3, 4, 7 and 8 are pairs of an upper surface side warp and a lower surface side warp. For convenience of explanation, warps 1 to 8 each includes two yarns.

On the upper side surface, warps form a plain weave design in which a warp alternately passes over and under upper surface side wefts. Each of the warp binding yarn 1 and two warp binding yarns 2 does not constitute a plain weave design on the upper side surface, but they get together and cooperatively form a 1/1 design similar to that of the upper surface side warp 1 on the upper side surface.

At a portion where a warp binding yarn passes over an upper surface side weft, it tends to pull the upper surface side weft downward. In the present invention, however, at this portion, another warp binding yarn passes under the upper surface side weft to support the upper surface side from the lower side so that no recess appears at the binding portion and the knuckles have a uniform height. Moreover, at a portion where a warp binding yarn passes over an upper surface side weft, the other two warp binding yarns lie under the upper surface side weft, which means that they lie between the upper surface side weft and a lower surface side weft or lie under the lower surface side weft so that water drainage spaces penetrating through the fabric in random oblique directions are formed, whereby the resulting fabric has an excellent water drainage property. In addition, a warp binding yarn is a longitudinal direction yarn onto which a tension is applied so that it has an excellent binding power. Since no additional binding yarn exists, the upper side surface design becomes uniform without being disturbed by it.

On the lower side surface, a 4/1-2/1 design is formed as in Example 1. A lower surface side weft passes over two adjacent warps on the lower surface side and then passes under six successive warps on the lower surface side to form a weft long crimp on the lower side surface. Lower surface side warps are arranged in a zigzag manner so that rigidity in the diagonal direction is improved. Owing to existence of both an overlap portion and a non-overlap portion between a warp on the upper surface side and a warp on the lower surface side, meshes with a random size or shape can be formed, which enables stepwise dehydration. This makes it possible to prevent generation of dehydration marks, sticking of a sheet raw material onto a wire or loss of fiber or filler from the wire.

Example 5

Figure 10:
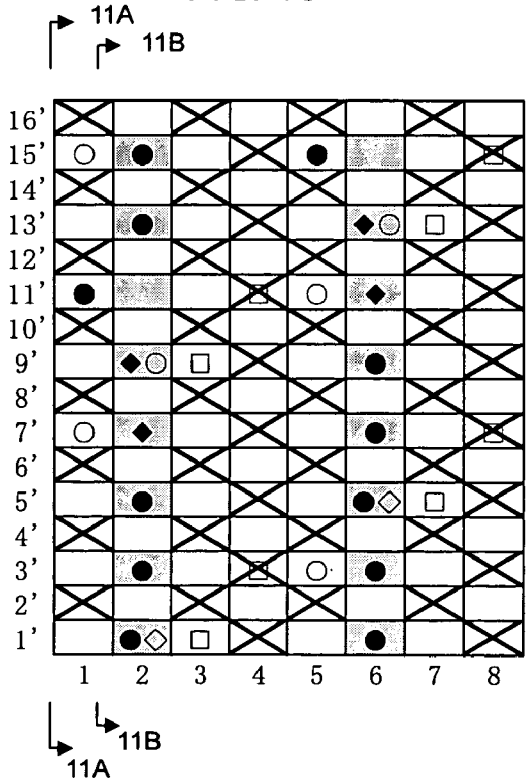
FIG. 10 is a design diagram of an industrial two-layer fabric of Example 5 according to the present invention.
Figure 11A:
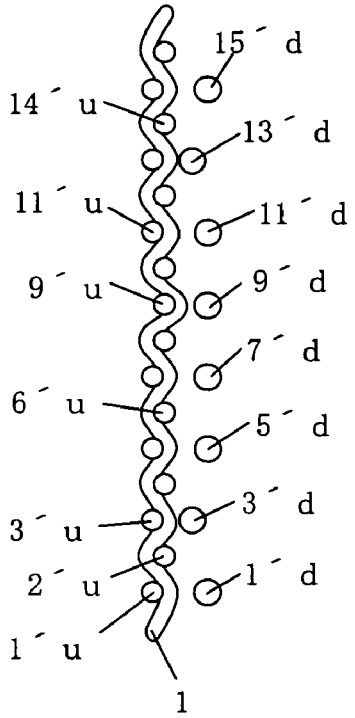
FIGS. 11A and 11B include cross-sectional views taken along the line 11A-11A of a first binding warp pair 1 and along the line 11B-11B of a second binding warp pair 2 in FIG. 10 respectively.
Figure 11B:
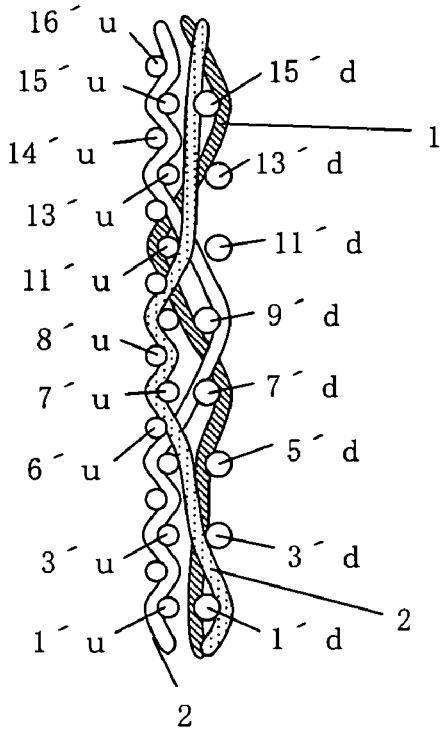

FIG. 10 is a design diagram of a fabric of Example 5 according to the present invention. FIGS. 11A and 11B include cross-sectional views of an upper surface side warp 1 and that of a warp binding yarn 1 and two warp binding yarns 2, each illustrated in the design diagram of FIG. 10. These three warp binding yarns get together and form a design corresponding to a warp on the upper side surface.

In the design diagram of FIG. 10, indicated at numerals 1 and 5 are pairs of an upper surface side warp and a warp binding yarn, indicated at numerals 2 and 6 are pairs of two warp binding yarns, and indicated at numerals 3, 4, 7 and 8 are warp pairs of an upper surface side warp and a lower surface side warp. For convenience of explanation, warps 1 to 8 each includes two yarns.

On the upper side surface, a plain weave design in which a warp alternately passes over and under upper surface side wefts is formed as in Example 4. Each of the warp binding yarn 1 and two warp binding yarns 2 does not constitute a plain weave design on the upper side surface, but they get together and cooperatively form a 1/1 design similar to that of the upper surface side warp 1 on the upper side surface.

At a portion where a warp binding yarn passes over an upper surface side weft, it tends to pull the upper surface side weft downward. In the present invention, however, at that portion, another warp binding yarn passes under the upper surface side weft to support the upper surface side weft from the lower side so that no recess appears at the binding portion and the knuckles have a uniform height. Moreover, at a portion where a warp binding yarn passes over an upper surface side weft, the other two warp binding yarns lie under the upper surface side weft, which means that they lie between the upper surface side weft and a lower surface side weft or lie under the lower surface side weft so that water drainage spaces penetrating through the fabric in random oblique directions are formed, whereby the resulting fabric has an excellent water drainage property. In addition, a warp binding yarn is a longitudinal direction yarn onto which a tension is applied so that it has an excellent binding power. Since no additional binding yarn exists, the upper side surface design becomes uniform without being disturbed by it.

On the lower side surface, a lower surface side warp passes under a lower surface side weft and then passes over three successive lower surface side wefts and this design is repeated. Two lower surface side warps which are adjacent to each other form the same design while passing over and under lower surface side wefts in a similar manner. A lower surface side weft passes over two warps on the lower surface side and then passes under six successive warps on the lower surface side to form a weft long crimp on the lower side surface. The design thus formed has excellent wear resistance.

Example 6

Figure 12:
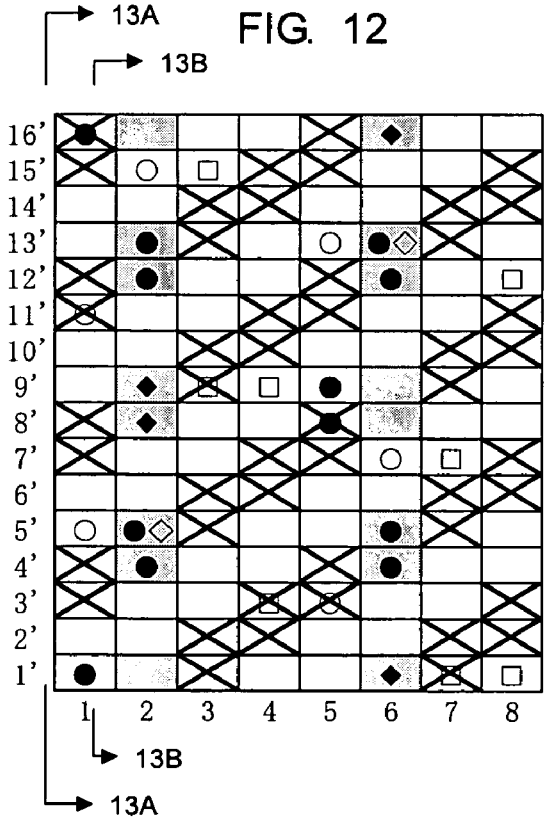
FIG. 12 is a design diagram of an industrial two-layer fabric of Example 6 according to the present invention.
Figure 13A:
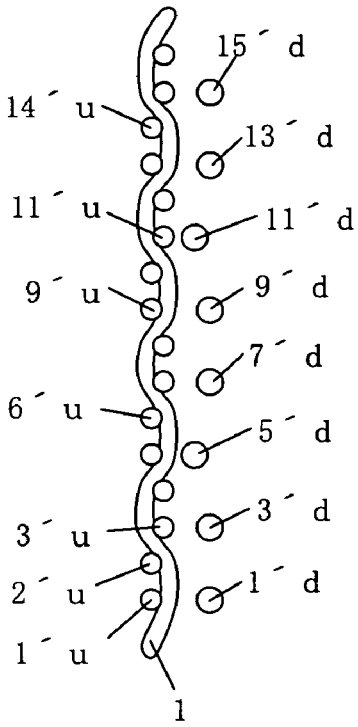
FIGS. 13A and 13B include cross-sectional views taken along the line 13A-13A of a first binding warp pair 1 and along the line 13B-13B of a second binding warp pair 2 in FIG. 12 respectively.
Figure 13B:
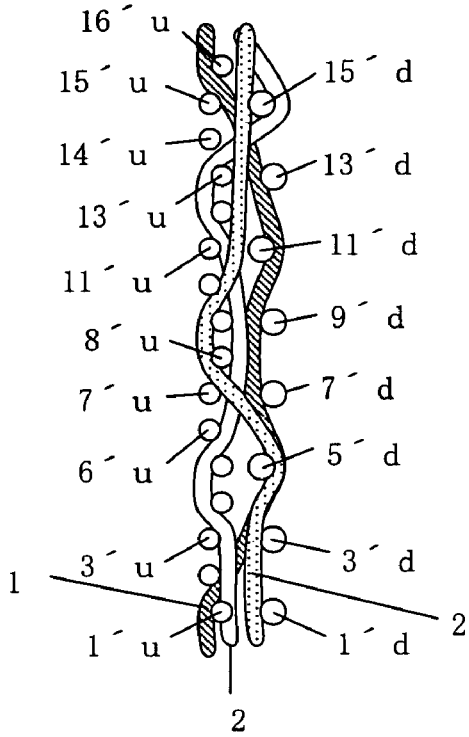

FIG. 12 is a design diagram of a fabric of Example 6 according to the present invention. FIGS. 13A and 13B include cross-sectional views of an upper surface side warp 1 and that of a warp binding yarn 1 and two warp binding yarns 2, each illustrated in the design diagram of FIG. 12. These three warp binding yarns get together and form a design corresponding to a warp on the upper side surface.

In the design diagram of FIG. 12, indicated at numerals 1 and 5 are pairs of an upper surface side warp and a warp binding yarn, indicated at numerals 2 and 6 are pairs of two warp binding yarns, and indicated at numerals 3, 4, 7 and 8 are pairs of an upper surface side warp and a lower surface side warp. For convenience, of explanation, warps 1 to 8 each includes two yarns.

On the upper side surface, a 2/2 design in which a warp passes over two upper surface side wefts and then passes under two upper surface side wefts is formed. Each of the warp binding yarn 1 and two warp binding yarns 2 does not constitute a 2/2 design on the upper side surface, but they get together and cooperatively form a 2/2 design similar to that of the upper surface side warp 1 on the upper side surface.

At a portion where a warp binding yarn passes over an upper surface side weft, it tends to pull the upper surface side weft downward. In the present invention, however, at that portion, another warp binding yarn passes under the upper surface side weft to support the upper surface side weft from the lower side so that no recess appears at the binding portion and the knuckles have a uniform height. Moreover, at a portion where a warp binding yarn passes over an upper surface side weft, the other two warp binding yarns lie under the upper surface side weft, which means that they lie between the upper surface side weft and a lower surface side weft or lie under the lower surface side weft so that water drainage spaces penetrating through the fabric in random oblique directions are formed, whereby the resulting fabric has an excellent water drainage property. In addition, a warp binding yarn is a longitudinal direction yarn onto which a tension is applied so that it has an excellent binding power. Since no additional binding yarn exists, the upper side surface design becomes uniform without being disturbed by it.

On the lower side surface, a 4/1-2/1 design similar to that of Example 1 is formed. A lower surface side weft passes over two adjacent warps on the lower surface side and passes under six successive warps on the lower surface side to form a weft long crimp on the lower side surface. Rigidity in the diagonal direction is improved owing to the employment of zigzag arrangement for lower surface side warps. Both an overlap portion and a non-overlap portion appear between warps on the upper surface side and warp on the lower surface side. Meshes with a random size or shape are therefore formed so that stepwise dehydration can be carried out. This makes it possible to prevent generation of dehydration marks, sticking of a sheet raw material onto a wire or loss of fiber or filler from the wire.

Example 7

Figure 14:
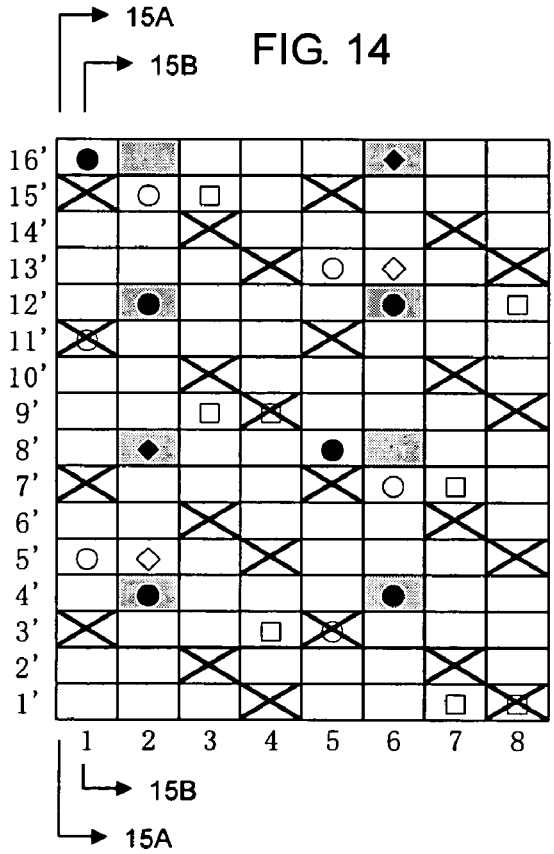
FIG. 14 is a design diagram of an industrial two-layer fabric of Example 7 according to the present invention.
Figure 15A:
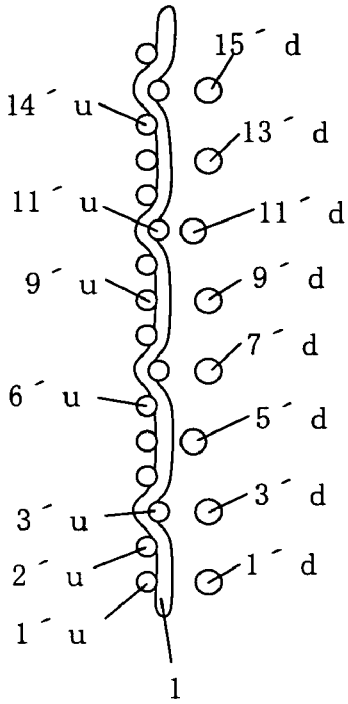
FIGS. 15A and 15B include cross-sectional views taken along the line 15A-15A of a first binding warp pair 1 and along the line 15B-15B of a second binding warp pair 2 in FIG. 14 respectively.
Figure 15B:
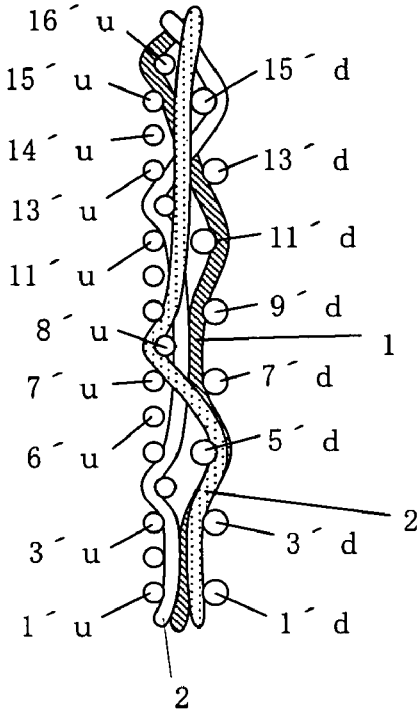

FIG. 14 is a design diagram of a fabric of Example 7 according to the present invention. FIGS. 15A and 15B include cross-sectional views of an upper surface side warp 1 and that of a warp binding yarn 1 and two warp binding yarns 2, each illustrated in the design diagram of FIG. 14. These three warp binding yarns get together and form a design corresponding to a warp on the upper side surface.

In the design diagram of FIG. 14, indicated at numerals 1 and 5 are pairs of an upper surface side warp and a warp binding yarn, indicated at numerals 2 and 6 are pairs of two warp binding yarns, and indicated at numerals 3, 4, 7 and 8 are warp pairs of an upper surface side warp and a lower surface side warp. For convenience of explanation, warps 1 to 8 each includes two yarns.

On the upper side surface, a sateen weave design obtained by irregularly changing a 1/3 design in which a warp passes over an upper surface side weft and under three upper surface side wefts is formed. Each of the warp binding yarn 1 and two warp binding yarns 2 does not constitute a 1/3 design on the upper side surface, but they get together and cooperatively form a 1/3 design similar to that of the upper surface side warp 1 on the upper side surface.

At a portion where a warp binding yarn passes over an upper surface side weft, it tends to pull the upper surface side weft downward. In the present invention, however, at that portion, another warp binding yarn passes under the upper surface side weft to support the upper surface side from the lower side so that no recess appears at the binding portion and the knuckles have a uniform height. Moreover, at a portion where a warp binding yarn passes over an upper surface side weft, the other two warp binding yarns lie under the upper surface side weft, which means that they lie between the upper surface side weft and a lower surface side weft or lie under the lower surface side weft so that water drainage spaces penetrating through the fabric in random oblique directions are formed, whereby the resulting fabric has an excellent water drainage property. In addition, a warp binding yarn is a longitudinal direction yarn onto which a tension is applied so that it has an excellent binding power. Since no additional binding yarn exists, the upper side surface design becomes uniform without being disturbed by it.

On the lower side surface, a 4/1-2/1 design similar to that of Example 1 is formed. A lower surface side weft has a design of passing over two adjacent warps on the lower surface side and passes under six successive warps on the lower surface side to form a weft long crimp on the lower surface side surface. Rigidity in the diagonal direction is improved owing to the employment of zigzag arrangement for lower surface side warps. Both an overlap portion and a non-overlap portion appear between warps on the upper surface side and warps on the lower surface side. Meshes with a random size or shape are therefore formed so that stepwise dehydration can be carried out. This makes it possible to prevent generation of dehydration marks, sticking of a sheet raw material onto a wire or loss of fiber or filler from the wire.

Example 8

Figure 16:
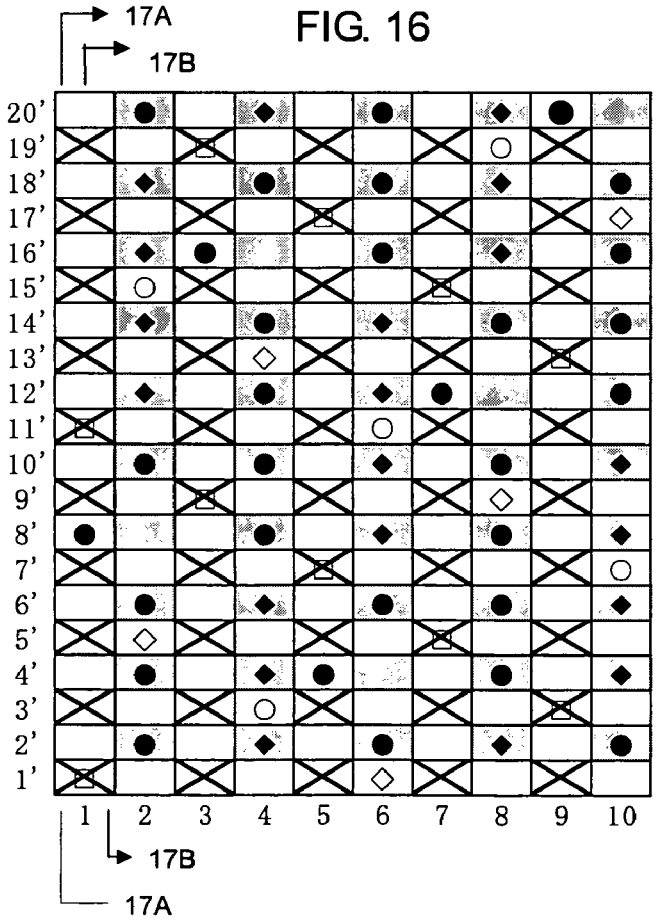
FIG. 16 is a design diagram of an industrial two-layer fabric of Example 8 according to the present invention.
Figure 17A:
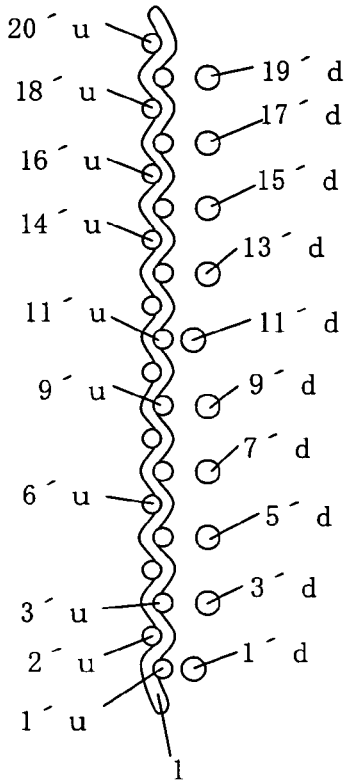
FIGS. 17A and 17B include cross-sectional views taken along the line 17A-17A of a first binding warp pair 1 and along the line 17B-17B of a second binding warp pair 2 in FIG. 16 respectively.
Figure 17B:
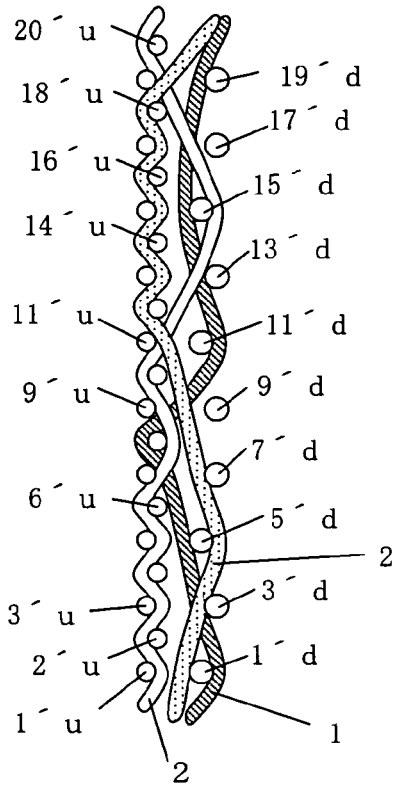

FIG. 16 is a design diagram of a fabric of Example 8 according to the present invention. FIGS. 17A and 17B include cross-sectional views of an upper surface side warp 1 and that of a warp binding yarn 1 and two warp binding yarns 2, each illustrated in the design diagram of FIG. 16. These three warp binding yarns get together and form a design corresponding to a warp on the upper side surface. The fabrics of Examples 1 to 7 are each a 16-shaft one, but the fabric of this example is a 20-shaft one.

In the design diagram of FIG. 16, indicated at numerals 1, 3, 5, 7 and 9 are pairs of an upper surface side warp and a warp binding yarn, while indicated at numerals 2, 4, 6, 8 and 10 are pairs of two warp binding yarns. In this example, no warp pair composed of an upper surface side warp and a lower surface side warp is disposed so that a warp constituting the lower side surface is only a warp binding yarn.

On the upper side surface, a plain weave design in which a warp alternately passes over and under upper surface side wefts is formed. Each of the warp binding yarn 1 and two warp binding yarns 2 does not constitute a plain weave design on the upper side surface, but these three yarns get together to constitute a 1/1 design similar to that of the upper surface side warp 1.

At a portion where a warp binding yarn passes over an upper surface side weft, it tends to pull the upper surface side weft downward. In the present invention, however, at this portion, another warp binding yarn passes under the upper surface side weft to support the upper surface side from the lower side so that no recess appears at the binding portion and the knuckles have a uniform height. Moreover, at a portion where a warp binding yarn passes over an upper surface side weft, the other two warp binding yarns lie under the upper surface side weft, which means that they lie between the upper surface side weft and a lower surface side weft or lie under the lower surface side weft so that water drainage spaces penetrating through the fabric in random oblique directions are formed, whereby the resulting fabric has an excellent water drainage property. In addition, a warp binding yarn is a longitudinal direction yarn onto which a tension is applied so that it has an excellent binding power. Since no additional binding yarn exists, the upper side surface design becomes uniform without being disturbed by it.

On the lower side surface, a design of passing under a lower surface side weft and then passing over four successive lower surface side wefts is formed. A lower surface side weft passes over a warp on the lower surface side, passes under four successive warps on the lower surface side, and then passes over a warp on the lower surface side to form a weft long crimp on the lower side surface. The design thus obtained has excellent wear resistance.

Example 9

Figure 18:
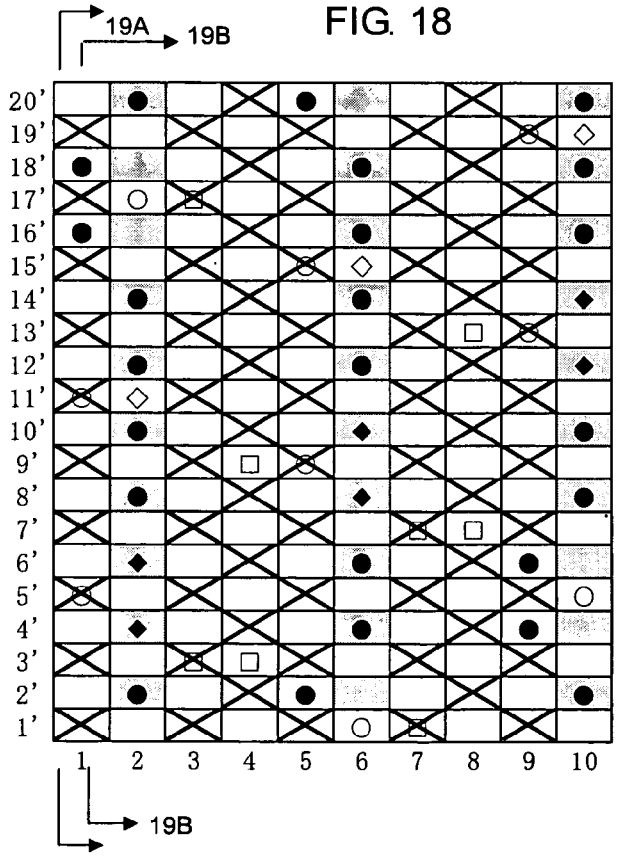
FIG. 18 is a design diagram of an industrial two-layer fabric of Example 9 according to the present invention.

FIG. 18 is a design diagram of a fabric of Example 9 according to the present invention. FIGS. 19A and 19B include cross-sectional views of an upper surface side warp 1 and that of a warp binding yarn 1 and two warp binding yarns 2, each illustrated in the design diagram of FIG. 18. These three warp binding yarns get together and form a design corresponding to a warp on the upper side surface. The fabric of this Example is a 20-shaft one similar to that of Example 8.

In the design diagram of FIG. 19, indicated at numerals 1, 5 and 9 are pairs of an upper surface side warp and a warp binding yarn, indicated at numerals 2, 6 and 10 are pairs of two warp binding yarns, and indicated at numerals 3, 4, 7 and 8 are warp pairs having an upper surface side warp and a lower surface side warp arranged vertically below the upper surface side warp. For convenience of explanation, warps 1 to 10 each includes two yarns.

On the upper side surface, a plain weave design in which a warp alternately passes over and under upper surface side wefts is formed. Each of the warp binding yarn 1 and two warp binding yarns 2 does not constitute a plain weave design on the upper side surface, but they get together and cooperatively form, on the upper side surface, a 1/1 design similar to that of the upper surface side warp 1.

At a portion where a warp binding yarn passes over an upper surface side weft, it tends to pull the upper surface side weft downward. In the present invention, however, at that portion, another warp binding yarn passes under the upper surface side weft to support the upper surface side from the lower side so that no recess appears at the binding portion and the knuckles have a uniform height. Moreover, at a portion where a warp binding yarn passes over an upper surface side weft, the other two warp binding yarns lie under the upper surface side weft, which means that these yarns lie between the upper surface side weft and a lower surface side weft or lie under the lower surface side weft so that water drainage spaces penetrating through the fabric in random oblique directions are formed, whereby the resulting fabric has an excellent water drainage property. In addition, a warp binding yarn is a longitudinal direction yarn onto which a tension is applied so that it has an excellent binding power. Since no additional binding yarn exists, the upper side surface design becomes uniform without being disturbed by it.

On the lower side surface, a 6/1-2/1 design is formed. A lower surface side weft has a design of passing over two adjacent warps on the lower surface side and passes under eight successive warps on the lower surface side to form a weft long crimp on the lower side surface. Rigidity in the diagonal direction is improved owing to the employment of zigzag arrangement for lower surface side warps. Both an overlap portion and a non-overlap portion appear between warps on the upper surface side and warps on the lower surface side. Meshes with a random size or shape are therefore formed so that stepwise dehydration can be carried out. This makes it possible to prevent generation of dehydration marks, sticking of a sheet raw material onto a wire or loss of fiber or filler from the wire.

Example 10

FIG. 20 is a design diagram of a fabric of Example 10 according to the present invention. FIGS. 21A and 21B include cross-sectional views of an upper surface side warp 1 and that of a warp binding yarn 1 and two warp binding yarns 2, each illustrated in the design diagram of FIG. 20. These three warp binding yarns get together and form a design corresponding to a warp on the upper side surface. The fabric in this Example is a 20-shaft one similar to that of Example 8, 9.

In the design diagram of FIG. 20, indicated at numerals 1 and 6 are pairs of an upper surface side warp and a warp binding yarn, indicated at numerals 2 and 7 are pairs of two warp binding yarns, and indicated at numerals 3, 4, 5, 8, 9 and 10 are warp pairs having an upper surface side warp and a lower surface side warp arranged vertically below the upper surface side warp. For convenience of explanation, warps 1 to 10 each includes two yarns.

On the upper side surface, a 2/3 design in which a warp passes over two upper surface side wefts and then passes under three upper surface side wefts is formed. Each of the warp binding yarn 1 and two warp binding yarns 2 does not constitute a 2/3 design on the upper side surface, but they get together and cooperatively form a 2/3 design similar to that of the upper surface side warp 1 on the upper side surface.

At a portion where a warp binding yarn passes over an upper surface side weft, it tends to pull the upper surface side weft downward. In the present invention, however, at that portion, another warp binding yarn passes under an upper surface side weft to support the upper surface side from the lower side so that no recess appears at the binding portion and the knuckles have a uniform height. Moreover, at a portion where a warp binding yarn passes over an upper surface side weft, the other two warp binding yarns lie under the upper surface side weft, which means that they lie between the upper surface side weft and a lower surface side weft or lie under the lower surface side weft so that water drainage spaces penetrating through the fabric in random oblique directions are formed, whereby the resulting fabric has an excellent water drainage property. In addition, a warp binding yarn is a longitudinal direction yarn onto which a tension is applied so that it has an excellent binding power. Since no additional binding yarn exists, the upper side surface design becomes uniform without being disturbed by it.

On the lower side surface, a 6/1-2/1 design similar to that of Example 9 is formed. A lower surface side weft has a design of passing over two adjacent warps on the lower surface side and passes under eight successive warps on the lower surface side to form a weft long crimp on the lower side surface. Rigidity in the diagonal direction is improved owing to the employment of zigzag arrangement for lower surface side warps. Both an overlap portion and a non-overlap portion appear between warps on the upper surface side and warp on the lower surface side. Meshes with a random size or shape are therefore formed so that stepwise dehydration can be carried out. This makes it possible to prevent generation of dehydration marks, sticking of a sheet raw material onto a wire or loss of fiber or filler from the wire.

Example 11

Figure 23A:
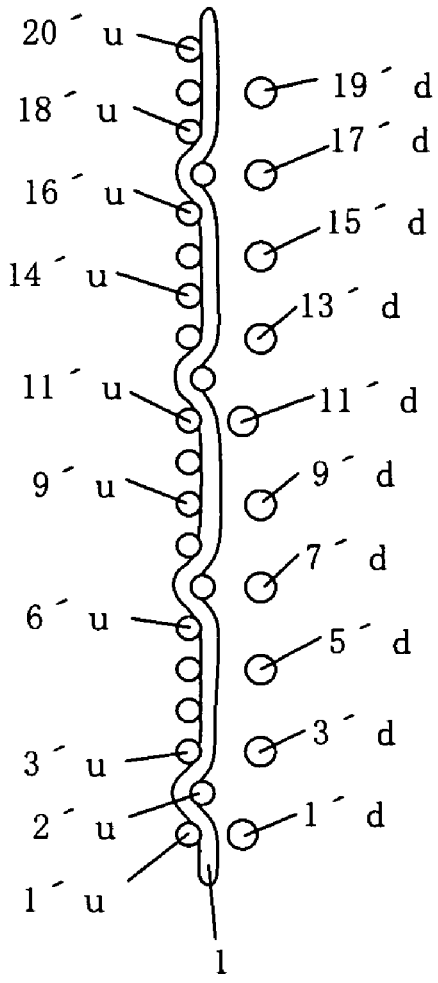
FIGS. 23A and 23B include cross-sectional views taken along the line 23A-23A of a first binding warp pair 1 and along the line 23B-23B of a second binding warp pair 2 in FIG. 22 respectively.
Figure 23B:
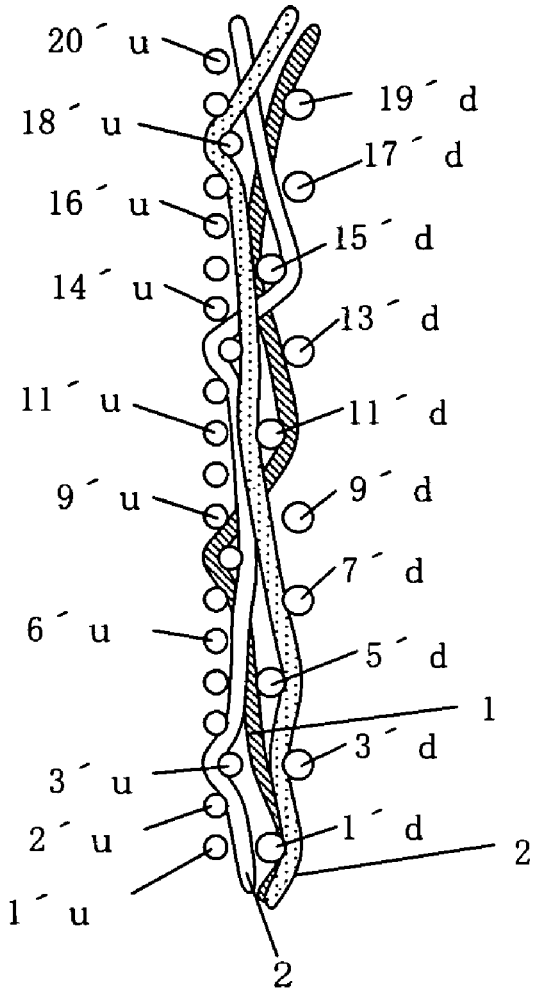

FIG. 22 is a design diagram of a fabric of Example 11 according to the present invention. FIGS. 23A and 23B include cross-sectional views of an upper surface side warp 1 and that of a warp binding yarn 1 and two warp binding yarns 2, each illustrated in the design diagram of FIG. 22. These three warp binding yarns get together and form a design corresponding to a warp on the upper side surface. The fabric of this example is a 20-shaft one similar to that of Example 8, 9, 10.

In the design diagram of FIG. 22, indicated at numerals 1 and 6 are pairs of an upper surface side warp and a warp binding yarn, indicated at numerals 2 and 7 are pairs of two warp binding yarns, and indicated at numerals 3, 4, 5, 8, 9 and 10 are warp pairs having an upper surface side warp and a lower surface side warp arranged vertically below the upper surface side warp. For convenience of explanation, warps 1 to 10 each includes two yarns.

On the upper side surface, a 1/4 design in which a warp passes over an upper surface side weft and then passes under four upper surface side wefts is formed. Each of the warp binding yarn 1 and two warp binding yarns 2 does not constitute a 1/4 weave design on the upper side surface, but they get together and cooperatively form a 1/4 design similar to that of the upper surface side warp 1 on the upper side surface.

At a portion where a warp binding yarn passes over an upper surface side weft, it tends to pull the upper surface side weft downward. In the present invention, however, at this portion, another warp binding yarn passes under an upper surface side weft to support the upper surface side from the lower side so that no recess appears at the binding portion and the knuckles have a uniform height. Moreover, at a portion where a warp binding yarn passes over an upper surface side weft, the other two warp binding yarns lie under the upper surface side weft, which means that they lie between the upper surface side weft and a lower surface side weft or lie under the lower surface side weft so that water drainage spaces penetrating through the fabric in random oblique directions are formed, whereby the resulting fabric has an excellent water drainage property. In addition, a warp binding yarn is a longitudinal direction yarn onto which a tension is applied so that it has an excellent binding power. Since no additional binding yarn exists, the upper side surface design becomes uniform without being disturbed by it.

On the lower side surface, a design of passing under a lower surface side weft and then passing over four successive lower surface side wefts is formed. A lower surface side weft passes over a warp on the lower surface side, passes under four successive warps on the lower surface side, passes over a warp on the lower surface side and then passes under four successive warps on the lower surface side to form a weft long crimp on the lower side surface. The design thus obtained has excellent wear resistance.

The fabric of the present invention hardly transfers its wire marks to paper, has excellent breathability, water drainage property, rigidity and wear resistance, and can keep conditions necessary for the manufacture of good quality paper for a prolonged period of time until the end of its life span.

Although only some exemplary embodiments of this invention have been described in detail above, those skilled in the art will readily appreciated that many modifications are possible in the exemplary embodiments without materially departing from the novel teachings and advantages of this invention. Accordingly, all such modifications are intended to be included within the scope of this invention.

The disclosure of Japanese Patent Application No. 2005-301561 filed Oct. 17, 2005 including specification, drawings and claims is incorporated herein by reference in its entirety.

What is claimed is:

1. An industrial two-layer fabric comprising an upper side layer and a lower side layer, wherein the upper side layer being comprised of an upper surface side warp that forms a warp design on an upper side surface, an upper surface side weft and a warp binding yarn for weaving an upper surface side weft and a lower surface side weft to bind the upper layer and the lower layer, wherein the lower side layer being comprised of a lower surface side warp, a lower surface side weft and the warp binding yarn, further wherein, in a repeating unit of the industrial two-layer fabric:

a first upper surface side warp that forms the warp design is disposed adjacent to three warp binding yarns;

each of the three warp binding yarns forms a binding yarn design by passing over one or two successive upper surface side wefts to form a knuckle on the upper side surface;

the three warp binding yarns appear on the upper side surface in turn, pass over respectively different upper surface side wefts, and form, on the upper side surface, knuckles, so that at least one upper surface side weft exists between any two of the knuckles; and the three warp binding yarns get together and form, adjacent to the first upper surface side warp, the warp design.

2. An industrial two-layer fabric according to claim 1, wherein, at a portion in which one of the three warp binding yarns passes over one upper surface side weft, the other two warp binding yarns pass under at least three upper surface side wefts including the one upper surface side weft.

3. An industrial two-layer fabric according to claim 1, wherein, in addition to the first upper surface side warp and the three warp binding yarns, a lower surface side warp is arranged vertically below a second upper surface side warp to form a pair.

4. An industrial two-layer fabric according to claim 1, wherein the three warp binding yarns have the binding yarn designs which are the same or respectively different.

5. An industrial two-layer fabric according to claim 1, wherein the three warp binding yarns get together and form the warp design on the upper side surface, woven together with the upper surface side warp and upper surface side weft, and form on the upper side surface any one of (i) a plain weave design, (ii) a twill weave design, a sateen weave design, (iii) a 1/4-1/2 design in which a warp passes over an upper surface side weft, passes under four successive upper surface side wefts, passes over an upper surface side weft and passes under two successive upper surface side wefts, or (iv) a 2/2 design in which a warp passes over two upper surface side wefts and passes under two upper surface side wefts.

6. An industrial two-layer fabric according to claim 1, wherein the lower surface side weft passes over two successive lower surface side warps and/or warp binding yarns and then passes under at least two successive lower surface side warps and/or warp binding yarns.

7. An industrial two-layer fabric according to claim 1, wherein the lower surface side weft passes over one lower surface side warp or warp binding yarn and then passes under at least two successive lower surface side warps and/or warp binding yarns.

8. An industrial two-layer fabric according to claim 1, wherein the three warp binding yarns comprises first, second, and third binding yarns, the second warp binding yarn being located next to the first warp binding yarn, and the third warp binding yarn being located next to the first warp binding yarn.

9. An industrial two-layer fabric according to claim 1, wherein the knuckles are aligned on one line.

* * * * *